US010760299B2

(12) United States Patent
Preston

(10) Patent No.: US 10,760,299 B2
(45) Date of Patent: Sep. 1, 2020

(54) FRAMELESS MODULAR WALL PANEL SYSTEMS, STRUCTURES AND RELATED METHODS

(71) Applicant: Aaron Preston, Ontario, NY (US)

(72) Inventor: Aaron Preston, Ontario, NY (US)

( * ) Notice: Subject to any disclaimer, the term of this patent is extended or adjusted under 35 U.S.C. 154(b) by 196 days.

(21) Appl. No.: 15/805,968

(22) Filed: Nov. 7, 2017

(65) Prior Publication Data

US 2018/0128011 A1 May 10, 2018

Related U.S. Application Data

(60) Provisional application No. 62/418,583, filed on Nov. 7, 2016.

(51) Int. Cl.
*E04H 17/20* (2006.01)
*E04H 17/16* (2006.01)
(Continued)

(52) U.S. Cl.
CPC ..... *E04H 17/168* (2013.01); *E04B 1/32* (2013.01); *E04B 1/34321* (2013.01);
(Continued)

(58) Field of Classification Search
CPC ..... E04H 17/168; E04H 17/20; E04B 1/321; E04B 2/7437
See application file for complete search history.

(56) References Cited

U.S. PATENT DOCUMENTS 3,617,028 A * 11/1971 Bach ..... E04F 11/1851 256/19
3,698,692 A * 10/1972 Burrows, Jr. ..... E04H 17/168 256/19
(Continued)

FOREIGN PATENT DOCUMENTS

CA 2727293 6/2011
CA 2771418 9/2013
(Continued)

OTHER PUBLICATIONS

Outdoor Kitchens & BBQ Island Kits, Feb. 10, 2016, 6 pages.
Sunset Bay Outdoor—Innovative Outdoor Products, Outdoor Heritage Collection, Feb. 13, 2016, 7 pages.

*Primary Examiner* — Daniel J Wiley
(74) *Attorney, Agent, or Firm* — Heslin Rothenberg Farley & Mesiti P.C.; Kristian E. Ziegler; Alana M. Fuierer

(57) ABSTRACT

Frameless modular wall systems, frameless modular free-standing wall structures, and related methods are disclosed. The systems and structures include a plurality of panels including a wall portion and connector portions extending from opposing lateral sides of the wall portion, the connector portions each including a wide portion and a narrow portion extending between the wide portions and the panel portion. The systems and structures also include a plurality of connecting posts including connector slots configured to removably accept a connector portion of a panel therein, the connector slots each including a wide portion and a narrow portion corresponding to the wide portion and a narrow portion of the connector portions of the panels. When the plurality of panels and the plurality of connecting posts are removably coupled via the connector portions and the connector slots, the panels and connecting posts form a free-standing wall structure.

20 Claims, 19 Drawing Sheets

(51) Int. Cl.
*E04B 2/74* (2006.01)
*E04B 1/343* (2006.01)
*E04B 1/32* (2006.01)

(52) U.S. Cl.
CPC ..... *E04B 2/7437* (2013.01); *E04H 17/20* (2013.01); *E04B 2001/3276* (2013.01); *E04B 2002/7461* (2013.01); *E04B 2002/7466* (2013.01)

(56) References Cited

U.S. PATENT DOCUMENTS 3,747,885 A * 7/1973 Ciancimino ..... F16B 12/32 248/188.1
3,841,042 A * 10/1974 Siegal ..... A47G 5/00 52/239
3,896,743 A * 7/1975 Pariente ..... A47B 47/00 108/190
3,951,294 A * 4/1976 Wilson ..... B65F 1/02 220/4.31
4,193,584 A * 3/1980 Wieser ..... A01K 1/0005 119/513
4,231,552 A * 11/1980 Thomas ..... E04H 17/168 256/24
4,594,829 A * 6/1986 Herrgord ..... E05D 1/04 52/282.3
4,605,090 A * 8/1986 Melfi ..... E01F 8/0017 181/210
4,920,695 A * 5/1990 Garden ..... A01G 9/022 47/67
4,968,171 A * 11/1990 Shell ..... E04B 2/7427 16/224
5,291,708 A * 3/1994 Johnson ..... E02D 27/01 52/282.2
5,375,369 A * 12/1994 VerHoeve ..... A01G 9/28 47/33
5,445,362 A * 8/1995 Reppert ..... A01G 9/28 256/24
5,529,423 A * 6/1996 Burke ..... A63B 9/00 403/169
5,538,363 A * 7/1996 Eastwood ..... E02D 29/0233 256/19
5,647,650 A * 7/1997 Daugherty ..... A47B 57/565 312/265.1
5,887,404 A * 3/1999 Kreizinger ..... B28B 7/20 256/19
6,293,523 B1 * 9/2001 Fendler ..... E04H 17/168 256/24
6,571,521 B1 * 6/2003 Ameigh ..... E04C 1/395 256/1
6,682,255 B2 * 1/2004 Battaglia ..... A47F 5/14 403/381
6,884,002 B1 * 4/2005 Fuller ..... E02B 7/22 405/114
7,201,458 B2 4/2007 DeMars
7,546,900 B2 * 6/2009 Humphries ..... B64F 1/26 181/284
7,836,653 B1 * 11/2010 Herrington ..... F24F 1/58 256/25
8,162,638 B2 * 4/2012 Stott ..... B28B 7/002 249/112
8,511,293 B2 8/2013 Thompson et al.
8,733,851 B2 5/2014 Lee
8,904,706 B1 * 12/2014 Smith ..... A01G 9/027 47/65.6
9,476,221 B2 * 10/2016 Marshall ..... E04H 17/168
10,422,156 B1 * 9/2019 Morrow ..... E04H 17/22
2005/0246969 A1 11/2005 Jarski
2007/0257585 A1 11/2007 Kenny et al.
2008/0120905 A1 * 5/2008 Pai ..... A01G 9/28 47/66.1
2009/0188188 A1 7/2009 Rivet
2010/0148641 A1 6/2010 Ehmke
2012/0153782 A1 6/2012 Fraser
2013/0113343 A1 5/2013 Singlak et al.
2015/0017377 A1 1/2015 Graham et al.
2015/0074896 A1 3/2015 Oxboel
2015/0238009 A1 8/2015 Ehmke et al.

FOREIGN PATENT DOCUMENTS

EP 0997087 5/2000
WO 2012081044 6/2012

* cited by examiner

FRAMELESS MODULAR WALL PANEL SYSTEMS, STRUCTURES AND RELATED METHODS

CROSS-REFERENCE TO RELATED APPLICATION

This application perfects and claims the benefit of U.S. Provisional Patent Application No. 62/418,583, filed on Nov. 7, 2016, and entitled frameless Modular Wall Panel System, which is hereby expressively incorporated herein by reference in its entirety.

FIELD OF THE INVENTION

The present invention generally relates to the field of modular wall panel systems, and, in particular, to frameless, pre-finished modular wall panel systems.

BACKGROUND

The prior art is replete with modular building systems and associated construction methods. However, current modular building systems and methods suffer from a variety of problems. For example, typical modular building systems and methods are highly complex and labor intensive, thereby requiring skill and/or knowledge in construction that increases the costs and assembly time of the systems. Such systems are consequently incompatible or unsuited for many users. Many typical modular building structures also require numerous individual fasteners to secure components of the structures together which add manufacturing and assembly costs, prevent the structures from being reconfigurable, and/or represent weak points of the structure.

Still further, many current modular building structures and methods include, or are configured to couple to, a foundation that provides structural support to the modular components of the system. For example, some modular building systems and methods make use of a foundation or footing as the element that connects the system to the ground, and thereby transfers loads from the structure to the ground. Foundations may be formed over a ground surface, or may be shallow or deep foundations that are embedded within the ground. Foundations are typically permanent or at least difficult to relocate or reconfigure, and thereby prevent the structures from being reconfigurable. Further, foundations are relatively costly and time consuming to install.

Modular building structures and methods also typically utilize a frame or framing to provide structural support and a shape to the modular components of the system. For example, typical modular building systems and methods make use of an internal frame coupled to a foundation or to the ground to provide an internal structural framework to which the modular components of the system are attached. The frame thereby dictates the shape, size and orientation of the resulting structure. Frames are typically permanent constructs, or are at least difficult to reconfigure, and thereby prevent the structures from being reconfigurable.

Accordingly, frameless modular wall systems that are reconfigurable are desirable. Further, modular wall systems that do not require a foundation and/or numerous fasteners are desirable. Still further, modular wall systems that are relatively simple and require minimal labor to install are also desirable.

SUMMARY

The present disclosure provides a modular system for building or creating a walled structure, such as an outdoor wall structure. The modular wall system is a relatively low cost building solution that installs with relative ease. The modular system is primarily formed of connecting members or posts and panels that are interchangeable and couple together in a sliding manner without the need of fasteners or tools. The connecting posts and panels may be pre-finished such that the resulting structure is complete and decorative immediately upon installation.

In some embodiments, the system may include a plurality of differing connecting posts that are configured to couple adjacent panels in differing relative orientations (e.g., angular orientations) with respect to each other. For example, the connecting posts may couple adjacent panels in a parallel arrangement (e.g., a straight wall), at 45°, at 90°, at 135°, etc. The front outer surface of the connecting posts may be planar or include planar portions, or may be arcuate or curvilinear. The connecting posts may thereby be utilized (with or without at least one wall panel) to form fences, decorative walls, pillars, decorative mailboxes, or any other walled structure.

Similarly, the system may include a plurality of panels of differing lengths and/or heights and, potentially, planar and/or non-planar panels. Similarly, the outer front surface of the panels may include any decoration or finish. In some embodiments, some panels may be configured to accept items therein or therethrough, such as grills, cabinets, refrigerators, etc. In this way, such specialized panels may at least abut and/or partially surround (and may support) an appliance or other item that is utilized with the walled structure. By utilizing differing combinations of such connecting posts and panels, any configuration or arrangement of a modular wall structure can be formed. For example, the system may allow a user to create their own walled structure design, with the potential to build-out (or take away from) and/or rearrange with the wall structure over time.

In some embodiments, the posts and/or the panels may be pre-formed and complete such that they each are a single piece or component. In some such embodiments, the posts and/or the panels may be of one-piece construction (e.g., integral or monolithic). The posts and/or the panels may be formed out of an artificial material (e.g., cementitious), and a decorative motif may or may not applied thereto (e.g., using a mold and pattern transfer technique or other appropriate process). The material forming the posts and/or the panels may be colored or weatherproofed. The posts and/or the panels may be sufficiently heavy to form a stable free-standing structure, but be light enough to enable hand assembly (and disassembly) by one or more user.

The posts and panels of the modular system may be configured to form an independent free-standing structure. In this way, the modular system may be a frameless systems. In some embodiments, the one-piece posts may be configured to couple and support adjacent panels in such a manner that produces a seamless appearance. The posts and panels may removably couple tougher via a tongue and groove configuration that prevents the components from disengaging during use but allows for selective disassembly and reuse (potentially in a differing configuration), if desired.

In one aspect, the present disclosure provides a frameless modular wall system. The system includes a plurality of panels including a wall portion and connector portions extending from opposing lateral sides of the wall portion, the connector portions each including a wide portion and a narrow portion extending between the wide portions and the panel portion. The system also includes a plurality of connecting posts including connector slots configured to removably accept a connector portion of a panel therein, the connector slots each including a wide portion and a narrow portion corresponding to the wide portion and a narrow portion of the connector portions of the panes. When the plurality of panels and the plurality of connecting posts are removably coupled via the connector portions and the connector slots, the panels and connecting posts form a free-standing wall structure.

In some embodiments, the connector portions define lateral free ends of the panels. In some embodiments, the plurality of connecting posts include at least one connecting post that forms an outside corner between adjacent panels removably couple thereto. In some embodiments, the plurality of connecting posts include at least one connecting post that form an inside corner between adjacent panels removably couple thereto. In some embodiments, the wall portion of the plurality of panels include a pre-finished front face. In some embodiments, the connecting posts include a pre-finished front face extending between a pair of connector slots.

In some embodiments, the wall portion of the plurality of panels includes a front face extending between a pair of connector slots. In some such embodiments, the plurality of panels include at least one panel that includes a planar front face. In some other such embodiments, the plurality of panels include at least one panel that includes an arcuate front face.

In some embodiments, the connecting posts include a front face extending between a pair of connector slots. In some such embodiments, the plurality of connecting posts include at least one connecting post that includes a planar front face. In some other such embodiments, the plurality of connecting posts include at least one connecting post that includes an arcuate front face.

In some embodiments, the plurality of connecting posts are each of one-piece construction. In some embodiments, the plurality of connecting posts and/or the plurality of panels are molded from a cementitious material. In some embodiments, the plurality of connecting posts include connecting posts that form differing relative orientations of a pair of adjacent panels removably couple thereto. In some embodiments, the plurality of panels comprise panels of differing lateral lengths and/or heights.

In some embodiments, the free-standing wall structure forms an inner void extending between inner surfaces of the plurality of panels and plurality of connecting posts that is void of a support frame. In some such embodiments, the free-standing wall structure overlies a ground surface and is not affixed thereto.

In another aspect, the present disclosure provides a frameless, modular, free-standing wall structure. The structure includes a plurality of one-piece panels including a wall portion and connector portions extending from opposing lateral sides of the wall portion, the connector portions each including a wide portion and a narrow portion extending between the wide portions and the panel portion. The structure also includes a plurality of one-piece connecting posts including connector slots configured to removably accept a connector portion of a panel therein, the connector slots each including a wide portion and a narrow portion corresponding to the wide portion and a narrow portion of the connector portions of the panels. The plurality of panels and the plurality of connecting posts are removably coupled via the connector portions and the connector slots.

In another aspect, the present disclosure provides a method of forming a free-standing wall structure. The method includes assembling a frameless modular wall system. The assembling includes obtaining a plurality of panels that each include a wall portion and connector portions extending from opposing lateral sides of the wall portion, the connector portions each including a wide portion and a narrow portion extending between the wide portions and the panel portion. The assembling also includes obtaining a plurality of connecting posts including connector slots configured to removably accept a connector portion of a panel therein, the connector slots each including a wide portion and a narrow portion corresponding to the wide portion and a narrow portion of the connector portions of the panels. The assembling further includes removably coupling the panels and the connecting posts via the connector portions and the connector slots thereof into a desired free-standing wall structure configuration.

Other objects, aspects and advantages of the modular wall systems of the present disclosure, and/or of the currently preferred embodiments thereof, will become more readily apparent in view of the following detailed description of the currently preferred embodiments and the accompanying drawings.

DETAILED DESCRIPTION

Each embodiment presented below facilitates the explanation of certain aspects of the disclosure, and should not be interpreted as limiting the scope of the disclosure. Moreover, approximating language, as used herein throughout the specification and claims, may be applied to modify any quantitative representation that could permissibly vary without resulting in a change in the basic function to which it is related. Accordingly, a value modified by a term or terms, such as "about," is not limited to the precise value specified. In some instances, the approximating language may correspond to the precision of an instrument for measuring the value. When introducing elements of various embodiments, the articles "a," "an," "the," and "said" are intended to mean that there are one or more of the elements. The terms "comprising," "including," and "having" are intended to be inclusive and mean that there may be additional elements other than the listed elements. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. The term "coupled" and like terms are used herein to refer to both direct and indirect connections. Any examples of operating parameters are not exclusive of other parameters of the disclosed embodiments. Components, aspects, features, configurations, arrangements, uses and the like described, illustrated or otherwise disclosed herein with respect to any particular embodiment may similarly be applied to any other embodiment disclosed herein.

Figure 1:
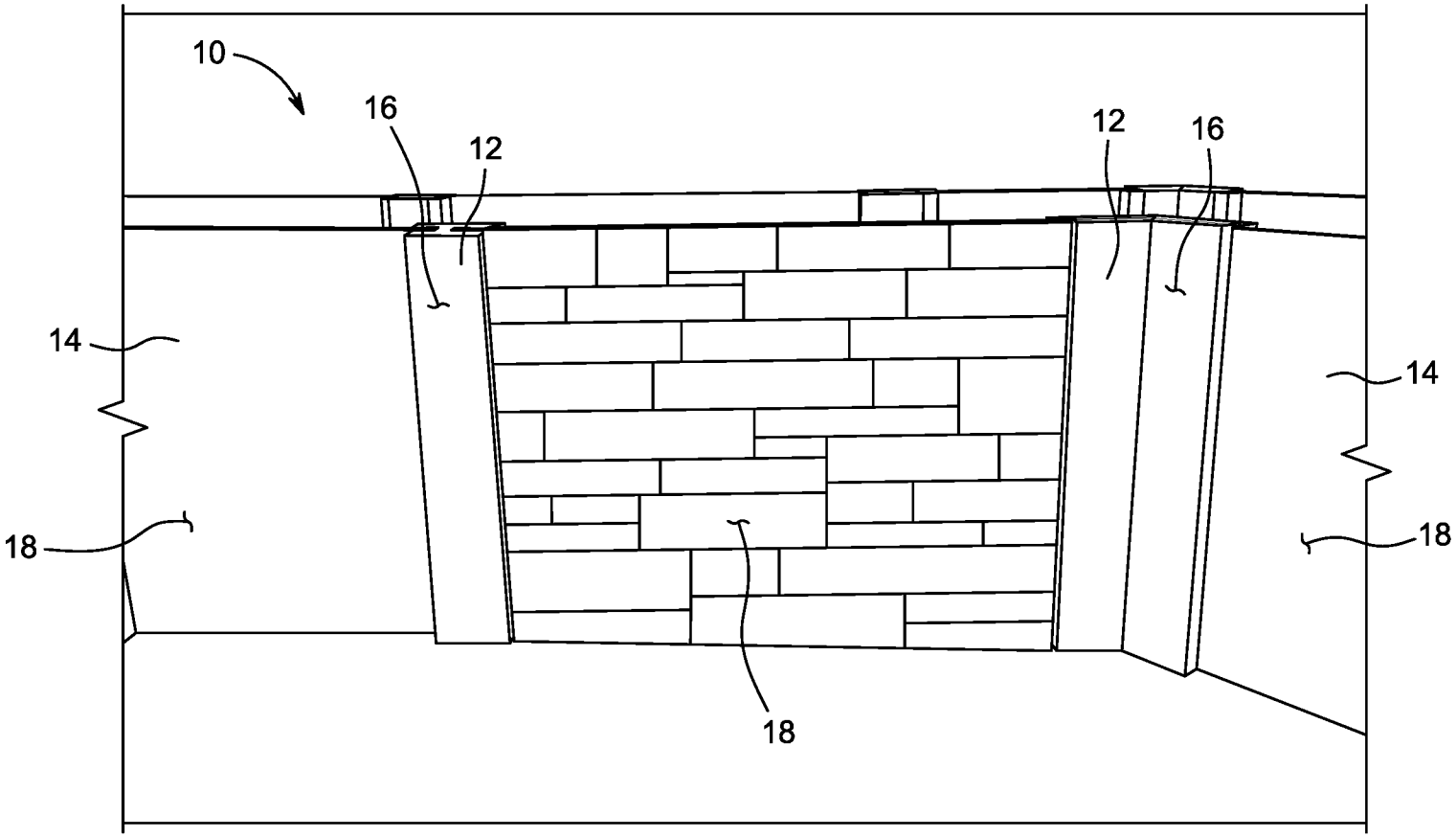
FIG. 1 is a perspective view of an exemplary embodiment of an assembled modular wall system according to the present disclosure.
Figure 2:
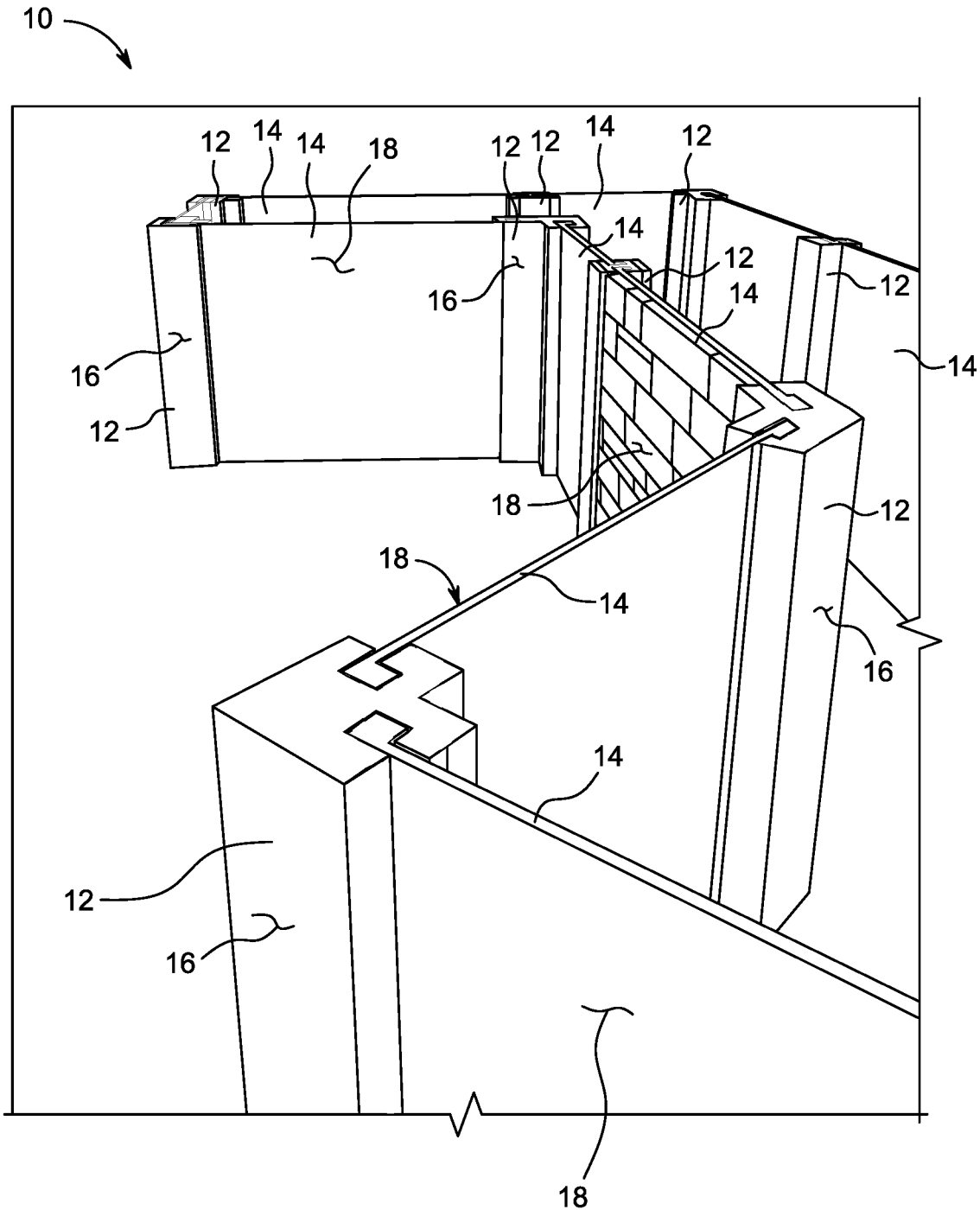
FIG. 2 is another perspective view of the assembled modular wall system of FIG. 1.
Figure 3:
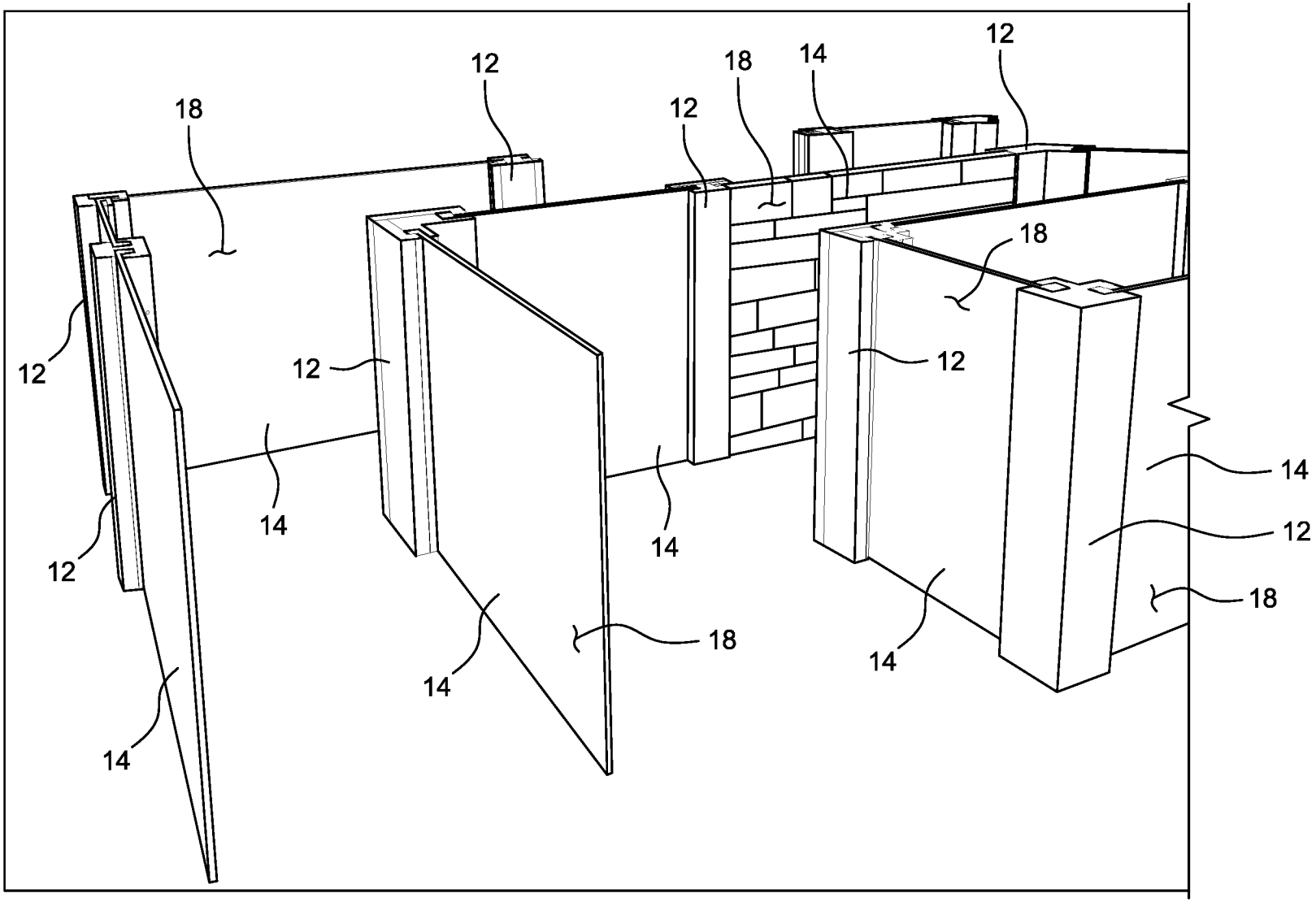
FIG. 3 is another perspective view of the assembled modular wall system of FIG. 1.

In FIGS. 1-3, a modular wall system and structure embodying a first embodiment of the present disclosure is indicated generally by the reference numeral 10. As shown in FIGS. 1-3, the modular wall system 10, when assembled, may form a walled structure or a series of walls. The wall system 10 may be a relatively low-cost building solution that installs with relative ease. The wall system 10 may be at least primarily formed of connecting members or posts 12 and panels 14 that are interchangeable and couple together in a sliding manner without the need of fasteners or tools, as shown in FIGS. 1-3. In some embodiments, connecting posts 12 and/or panels 14 may be pre-finished such that the resulting structure is complete and decorative immediately upon assembly, as shown in FIGS. 1-3. In some other embodiments, the connecting posts 12 and/or panels 14 may include an un-finished surface that can be decorated or otherwise altered by the user pre- and/or post-assembly, as also shown in FIGS. 1-3.

In some embodiments, the system 10 may include a plurality of differing connecting posts 12 that are configured to couple panels 14 in differing relative orientations (e.g., angular orientations) with respect to each other, as shown in FIGS. 1-3. For example, the connecting posts 12 may couple at least a pair of adjacent panels 14 in a parallel arrangement (e.g., a straight wall), at 45°, at 90°, at 135°, etc. The front outer surface of the connecting posts 16 may be planar or include planar portions as shown in FIGS. 1-3, or may be arcuate or curvilinear. The connecting posts 12 may thereby be utilized (with or without at least one wall panel) to form fences, decorative walls, pillars, bars, decorative mailboxes, outdoor kitchens, or any other walled structure.

The system and structures 10 of the present disclosure may include a plurality of panels 14, as shown in FIGS. 1-3. The panels 14 may be of the same length and/or height as shown in FIGS. 1-3, or may differ in lengths and/or heights. Similarly, the panels 14 may be planar as shown in FIGS. 1-3, and/or the panels 14 may be non-planar. The outer front surface 18 of the panels 14 may include any decoration or finish. In some embodiments, one or more of the panels 14 of the system 10 may be configured to accept items therein or therethrough, such as grills, cabinets, refrigerators, etc. In this way, such specialized panels 14 may at least abut and/or partially surround (and may support) an appliance or other item that is utilized with the walled structure 10. By utilizing differing combinations of connecting posts 12 and panels 14, any configuration or arrangement of a frameless modular wall structure 10 can be formed. For example, the system 10 may allow a user to create their own free-standing, frameless modular walled structure design on any ground surface, with the potential to build-out (or take away from) and/or rearrange with the wall structure over time.

In some embodiments, the posts 12 and/or the panels 14 may be pre-formed and complete such that they each are a single piece or component (i.e., one piece parts or of one-piece construction). In some such embodiments, the posts 12 and/or the panels 14 may be of one-piece construction (e.g., they may be monolithic). The posts 12 and/or the panels 14 may be formed (e.g., molded) out of an artificial material (e.g., a cementitious material), with a decorative motif applied thereto using a mold and pattern transfer technique. The material forming the posts 12 and/or the panels 14 may be colored or weatherproofed. The posts 12 and/or the panels 14 may be sufficiently heavy and rigidity coupled to form a stable free-standing frameless (i.e., free on an internal and/or external frame supporting the panels 14 and/or posts 12) structure when assembled as shown in FIGS. 1-3, but may be light enough to facilitate hand assembly (and disassembly) by one or more user, as discussed further below.

The posts 12 and panels 14 of the modular system 10 may be configured to form an independent free-standing structure, as shown in FIGS. 1-3. As shown in FIGS. 1-3, the modular system 10 may be a frameless system such that there is no internal frame or other support structure providing structural support to the assembled wall structure. In some embodiments, the posts 12 may be configured to couple and support adjacent panels 14 in such a manner that produces a seamless appearance, as shown in FIGS. 1-3. The posts 12 and panels 14 may removably couple tougher via a tongue and slot or groove configuration, as shown in FIGS. 1-3, that is configured to prevent the components from disengaging during normal use but allows for selective disassembly and reuse (potentially in a differing configuration), if desired.

In some embodiments, the posts 12 and/or the panels 14 may be pre-formed and complete such that they each are a single piece or unitary component. In some such embodiments, the posts 12 and/or the panels 14 may be of one-piece construction. The posts 12 and/or the panels 14 may be formed out any material. In some embodiments, the posts 12 and/or the panels may be molded cementitious components (i.e., molded from cement or similar material, such as concrete). The posts 12 and/or the panels 14 may be sufficiently heavy and sufficiently securely coupled to form a stable, free-standing (i.e., frameless) wall structure when assembled, but be light enough to be assembled (and disassembled) by hand by one or more user.

Figure 4:
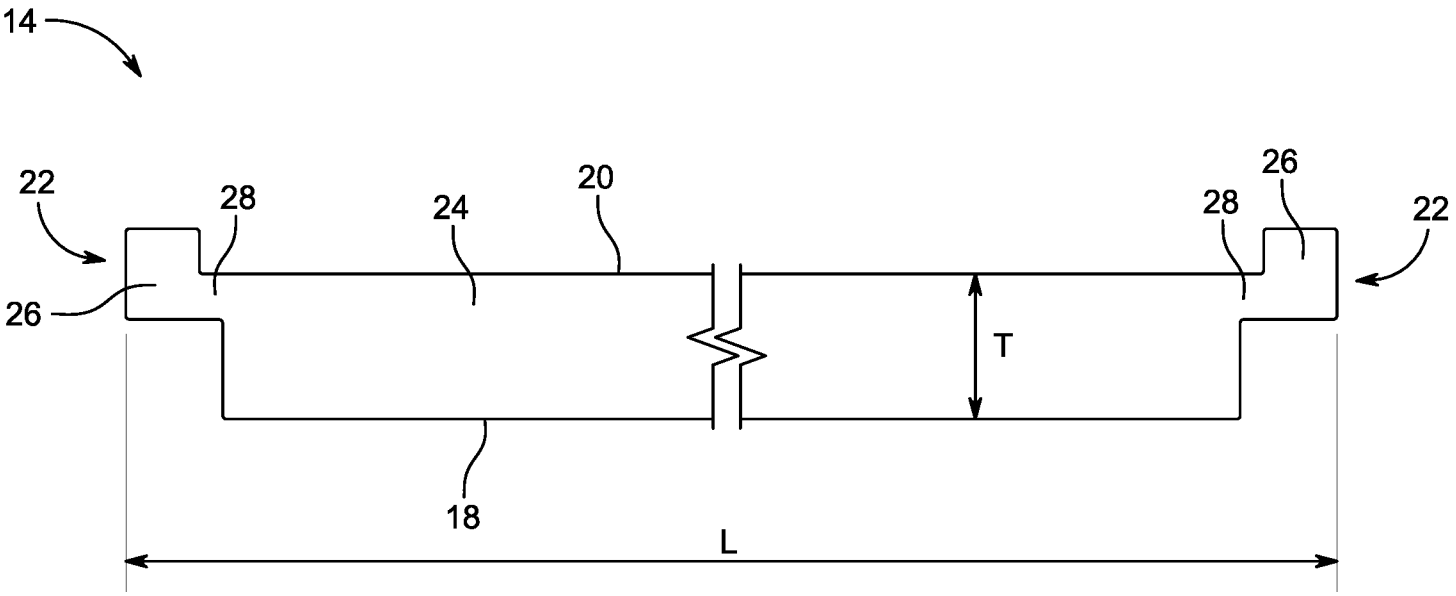
FIG. 4 is a top/bottom view of an exemplary wall panel of the modular wall system according to the present disclosure.
Figure 5:
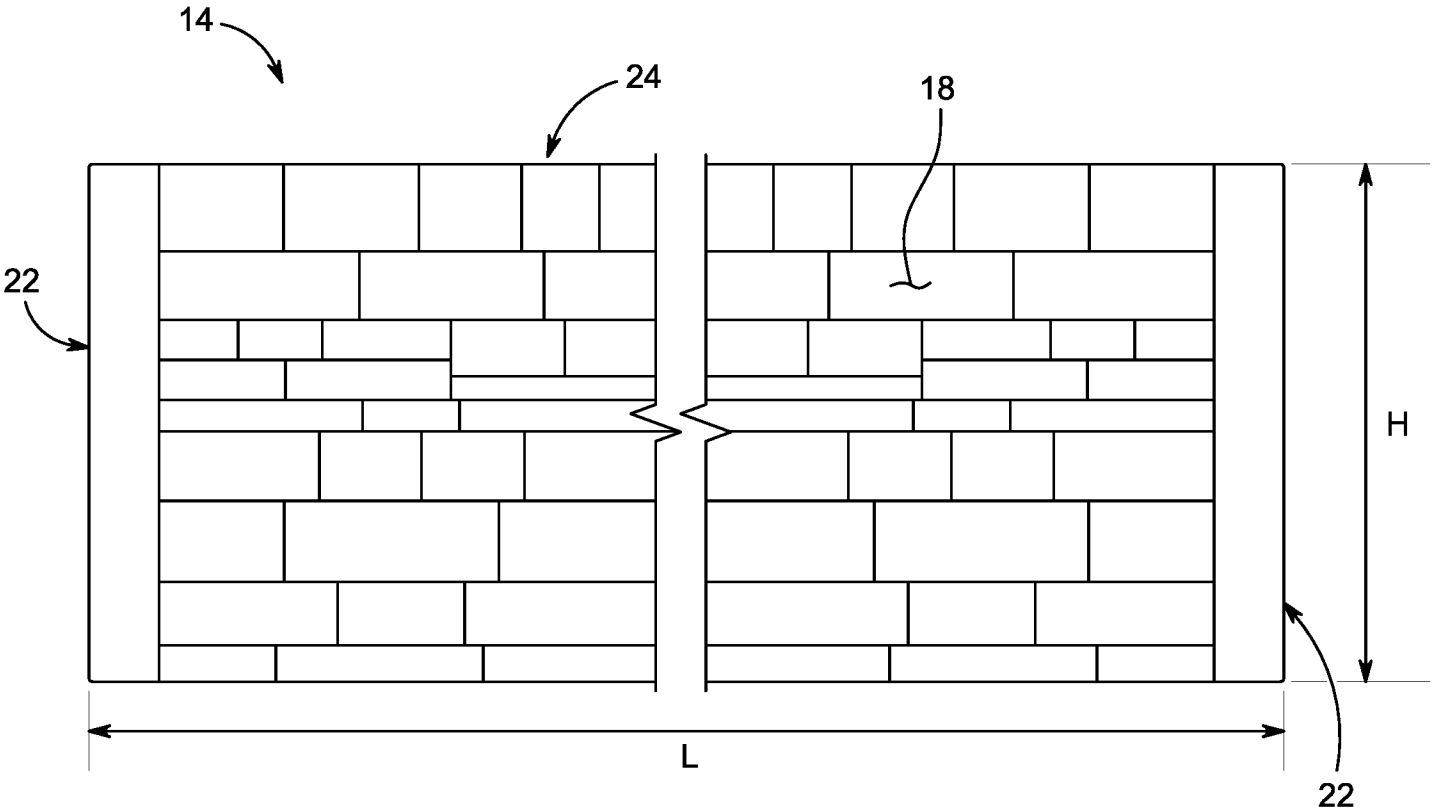
FIG. 5 is a front view of the wall panel of FIG. 4.
Figure 6:
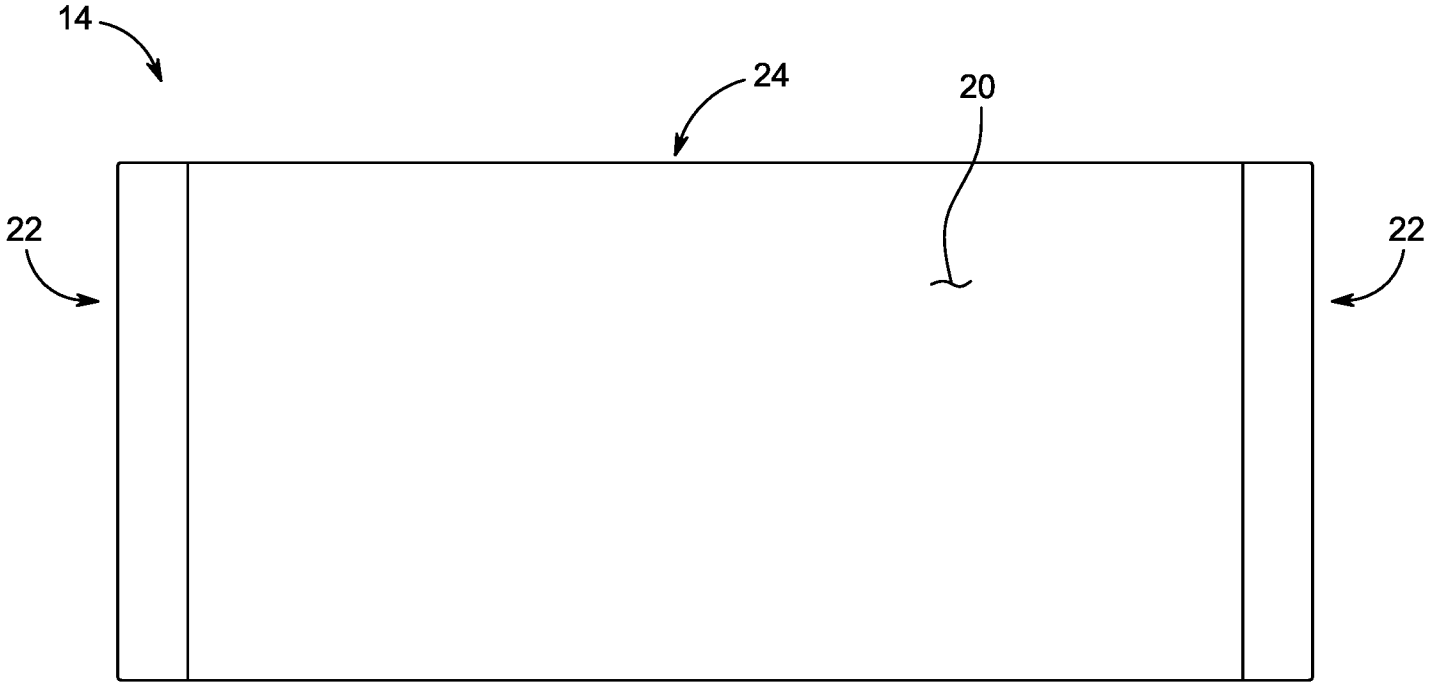
FIG. 6 is a back view of the wall panel of FIG. 4.

An exemplary planar panel 14 of the system 10 is illustrated in FIGS. 4-6. As shown in FIGS. 4-6, the panel 14 may include a wall portion 24 and a connector, connection or tongue portion 22 extending from at least one end of the wall portion 24 along the length L direction. In some embodiments, opposing lateral ends or sides of the wall portion 24 along the length L direction may include a connector portion 22 extending therefrom, as shown in FIGS. 4-6. In this way, the connector portions 22 may be positioned at opposing ends or sides of the wall portion 24 along the length L direction. The connector portion 22 may extend sustainably along the entirely of the height H of the panel 14 (i.e., along the entirely of the height H of the wall portion 14), as shown in FIG. 5. In some other embodiments, the connector portions 22 may extend along a portion of the height H of the panel 14 (i.e., along a portion of the height H of the wall portion 14). In some embodiments, at least one lateral side of the panel 14 (or wall portion) may include a plurality of connector portions (e.g., spaced along the length direction).

As shown in FIGS. 4-6, each panel 14 may form a front face 18 and a back face 20. As noted above, the front face 18 and/or the back face 20 of a panel 14 may or may not be finished or decorative (pre- and/or post-assembly). For example, the front face 18 and/or the back face 20 may include a faux stone or any other finish, which may be formed (at least partially) during the formation of the panel 14. In some embodiments, only the front face 18 may be finished or decorative (pre- and/or post-assembly). In some other embodiments, only back face 20 may be finished or decorative (pre- and/or post-assembly). In some other embodiments, both the front face 18 and the back face 20 may be finished or decorative (pre- and/or post-assembly).

As shown in FIG. 6, the front face 18 and/or back face 20 of the panel 14 may be substantially planar. In some other embodiments, as described below, at least one of the front face 18 and/or back face 20 of the panel 14 may be non-planar, such as arcuate or curvilinear. In some embodiments, the front face 18 and the back face 20 of the panel 14 may be substantially parallel such that the thickness T of the wall portion 24 is substantially uniform along the height H and length L of the panel 14, as shown in FIG. 6. In some other embodiments, the thickness T of the wall portion 14 of the panel 14 may vary along the height H and/or length L directions.

As shown in FIGS. 4-6, the connector or tongue portions 22 of the panel 14 may extend from the lateral sides or ends of the wall portion 24. As shown in FIG. 4, the connector portions 22 may be positioned proximate to the back face 20 along the thickness T direction. As also shown in FIG. 4, the connector portions 22 may extend linearly and, potentially, substantially parallel to the wall portion 24. In some other embodiments, the connector portions 22 may extend non-linearly and/or be angled/offset from the wall portion 24. The connector portions 22 may be configured such that when the wall portion 24 is orientated substantially vertically (e.g., along the height H direction), the connector portions 22 are orientated substantially vertically.

As shown in FIG. 4, the connector portions 22 may include a narrow portion 28 extending laterally from the wall portion along the length L direction and a wide portion 26 extending from the narrow portion 28. The wide portion 26 may define the lateral ends of the panels 14 along the length L direction. The wide portion 26 may be wider or larger in the thickness T direction than the narrow portion 28. The narrow portion 28 and/or the wide portion 26 may be thinner or smaller than the wall portion 24 along the thickness T direction. In some embodiments, the narrow portion 28 may include a back side and a front side spaced along the thickness T direction. The back side and a front side of the narrow portion 28 may be parallel and/or planar, or may be non-parallel and/or non-planar. In some embodiments as shown in FIG. 4, the back side of the narrow portion 28 may be aligned with the back face 20 of the wall portion 24 such that the back side is an extension of the back face 24 along the length L direction. In some other embodiments, the back side of the narrow portion 28 may be offset from the back face 20 of the wall portion 24 along the thickness T direction. As also shown in FIG. 4, the front side of the narrow portion 28 may be offset from the front face 18 of the wall portion 24 along the thickness T direction. For example, the front side of the narrow portion 28 may be offset from the front face 18 of the wall portion 24 along the thickness T direction towards the interior of the panel 14 (i.e., toward the back face thereof), as shown in FIG. 4. In some other embodiments (not shown), the front face of the narrow portion 28 may be offset from the front face 18 of the wall portion 24 along the thickness T direction away from the back face thereof such that the front face of the narrow portion 28 is positioned further forward than the front face 18 of the wall portion 24 (i.e., the front face 18 of the wall portion 24 is recessed toward the back side 20 of the panel 14 as compared to the front face of the narrow portion 28).

As shown in FIG. 4, the wide portion 26 of the connector portions 22 may extend from the narrow portion 28 laterally along the length L direction and define a thickness along the thickness T direction that is wider than the thickness of the narrow portions 28. In some embodiments, the wide portion 26 may include a back side and a front side spaced along the thickness T direction. The back side and a front side of the wide portion 26 may be parallel and/or planar, or may be non-parallel and/or non-planar. In some embodiments as shown in FIG. 4, the front side of the wide portion 26 may be aligned with the front face of the narrow portion 28 (and/or offset from the front face 18 of the wall portion 24 along the length L direction) such that the front side of the wide portion 26 is an extension of the front side of the narrow portion 28 along the length L direction. In some other embodiments, the front side of the wide portion 26 may be offset from the front side of the narrow portion 28 along the thickness T direction (toward, or away from, the back side thereof).

As also shown in FIG. 4, the back side of the wide portion 26 may be offset from the back side of the narrow portion 28 (and/or the front face 18 of the wall portion 24) along the thickness T direction. For example, the wide portion 26 may be thicker than the narrow portion 28 such that the back side of the wide portion 26 is further spaced along the thickness T direction from the front face of the wide portion 26 and/or the narrow portion 28 than the back side of the narrow portion 28 is spaced therefrom, as show in FIG. 4. The wide portion 26 may include a lateral side face that extends between the front side and the back side of the wide portion 26 along the thickness T direction. In some embodiments, the lateral side face of the wide portion 26 may be planar and/or extend perpendicular to the front side and/or the back side of the wide portion 26. In some other embodiments, the lateral side face of the wide portion 26 may be non-planar and/or be angled or askew from the front side and/or the back side of the wide portion 26.

Figure 7:
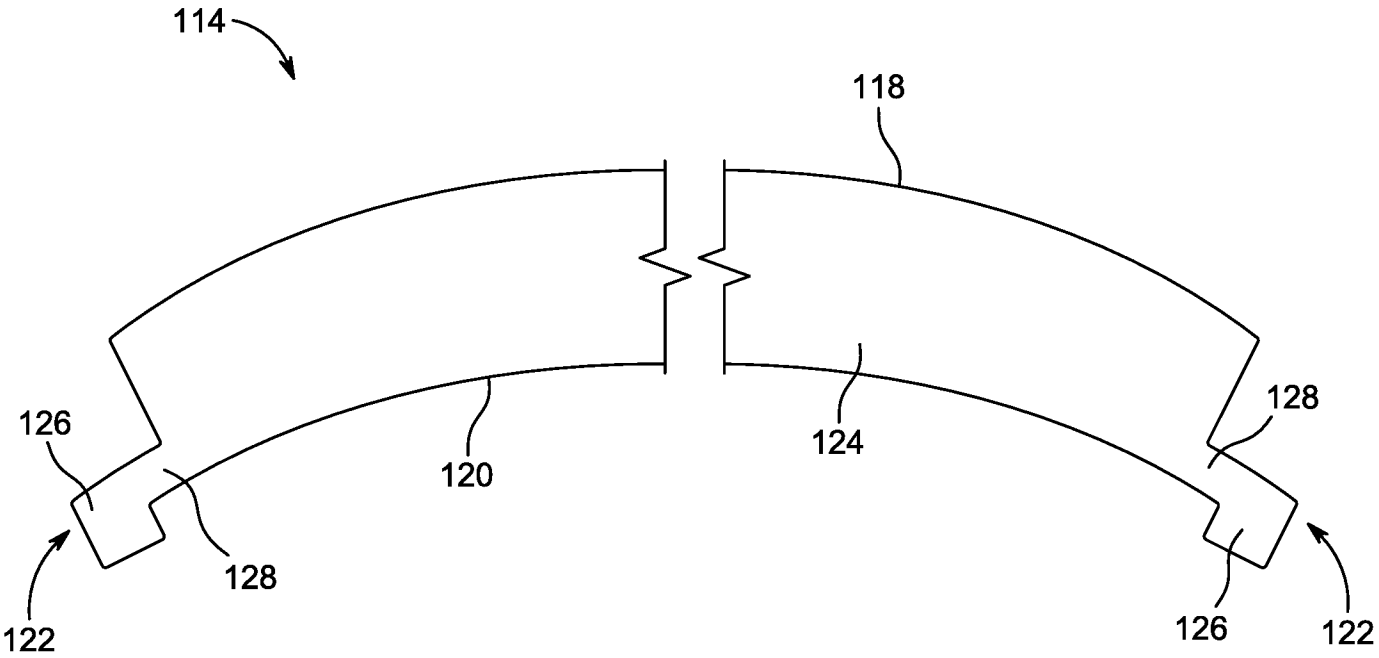
FIG. 7 is a top/bottom view of another an exemplary wall panel of the modular wall system according to the present disclosure.

In FIG. 7 an exemplary non-planar wall panel is indicated generally by the reference numeral 114. The exemplary wall panel 114 is substantially similar to exemplary wall panel 14 described above with reference to FIGS. 4-6, and therefore like reference numerals preceded by the numeral "1" are used to indicate like elements. A difference between the exemplary wall panel 114 and the exemplary wall panel 14 is the shape or orientation of the wall portion 124 of the panel. As shown in FIG. 7, the wall panel 114 may be non-planar such that the wall portion 112 may be non-planar. For example, the front face 118 and the back face 120 of the wall portion 124 may curved or arcuate, as shown in FIG. 7. In other non-planar embodiments, the wall portion 124 of the panel 114 (e.g., front face 118 and/or the back face 120) may be any other non-planar configuration besides curved. The wall portion 112 thereby may arcuately extend between the connector portions 122 along the length L direction.

Figure 10:
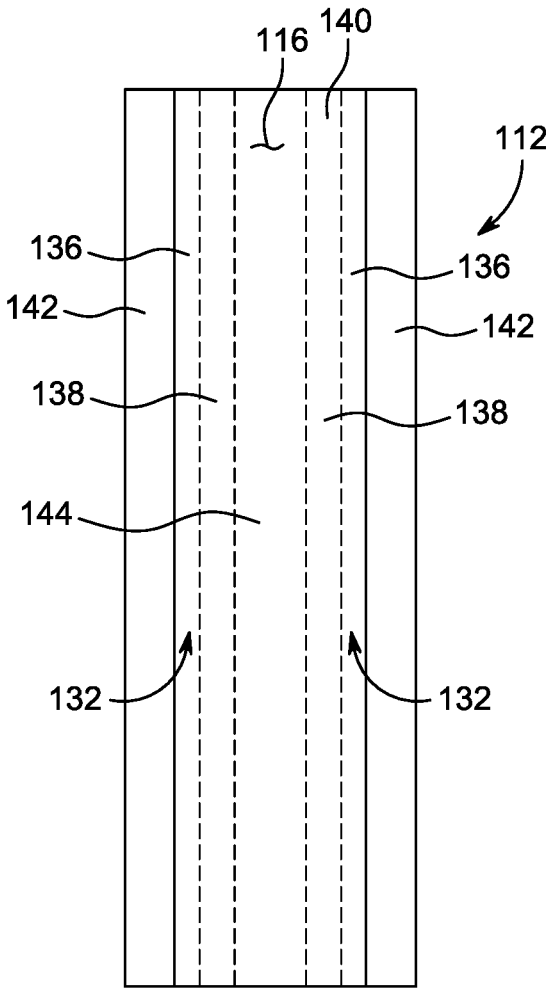
FIG. 10 is a back view of the connecting post of FIG. 8.
Figure 11:
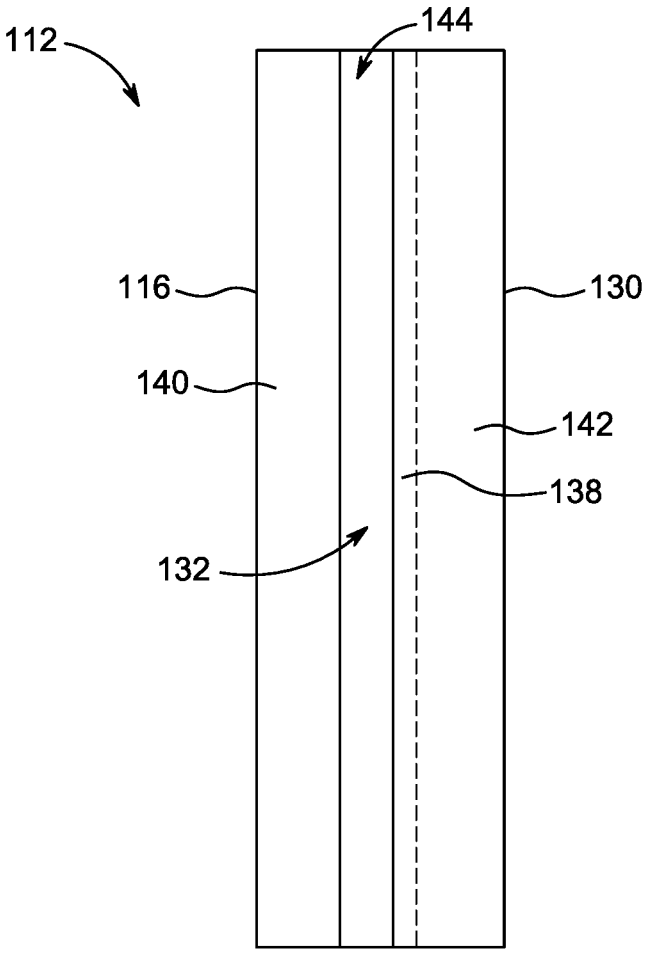
FIG. 11 is a side view of the connecting post of FIG. 8.
Figure 12:
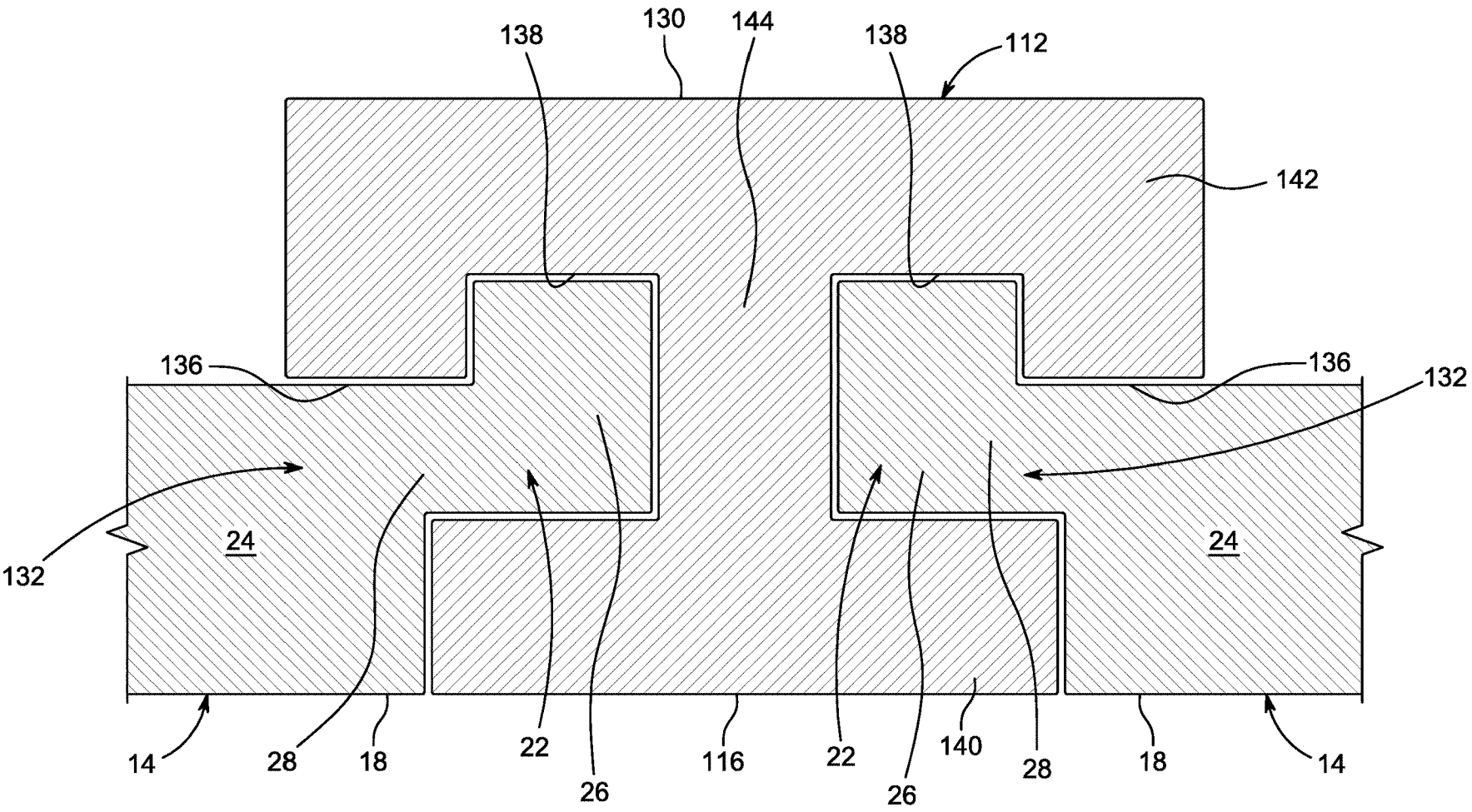
FIG. 12 is a top/bottom view of the connecting post of FIG. 8 coupling a pair of wall panels.

An exemplary connecting post 112 utilized in the modular wall system 10 of FIGS. 1-3 is shown in FIGS. 8-12. As shown in FIGS. 8-12, the connecting post 112 is a zero or 180 degree, linear or straight connector as it arranges the adjacent connector portions 22 of a pair of panels 14 (and thereby the panels 14 themselves) parallel to each other, in a continuous straight line, or in a mirrored arrangement. If the connecting post 112 is thereby utilized to connect two planar panels 14, such as two of the planar panels 14 of FIGS. 4-6, the front faces 18 thereof would be aligned and extend substantially parallel to each other, as shown in FIG. 12. However, as explained further below and shown in FIGS. 14-19, the connecting post 112 may be configured to couple two or more connector portions 22, and thereby the corresponding panels 14 themselves, in any arrangement, such as any non-parallel, non-continuous, non-mirrored or angled arrangement. Also, as discussed herein, the panels 14 may be non-planar and of any non-planar configuration. For example, one or more arcuate panel 114 may be coupled with the connecting post 112. While panel 14 may be utilized herein to describe differing connecting posts of the present disclosure, any panel configuration and/or arrangement may be utilized and panel 14 is only utilized for reference/explanatory purposes.

Figure 8:
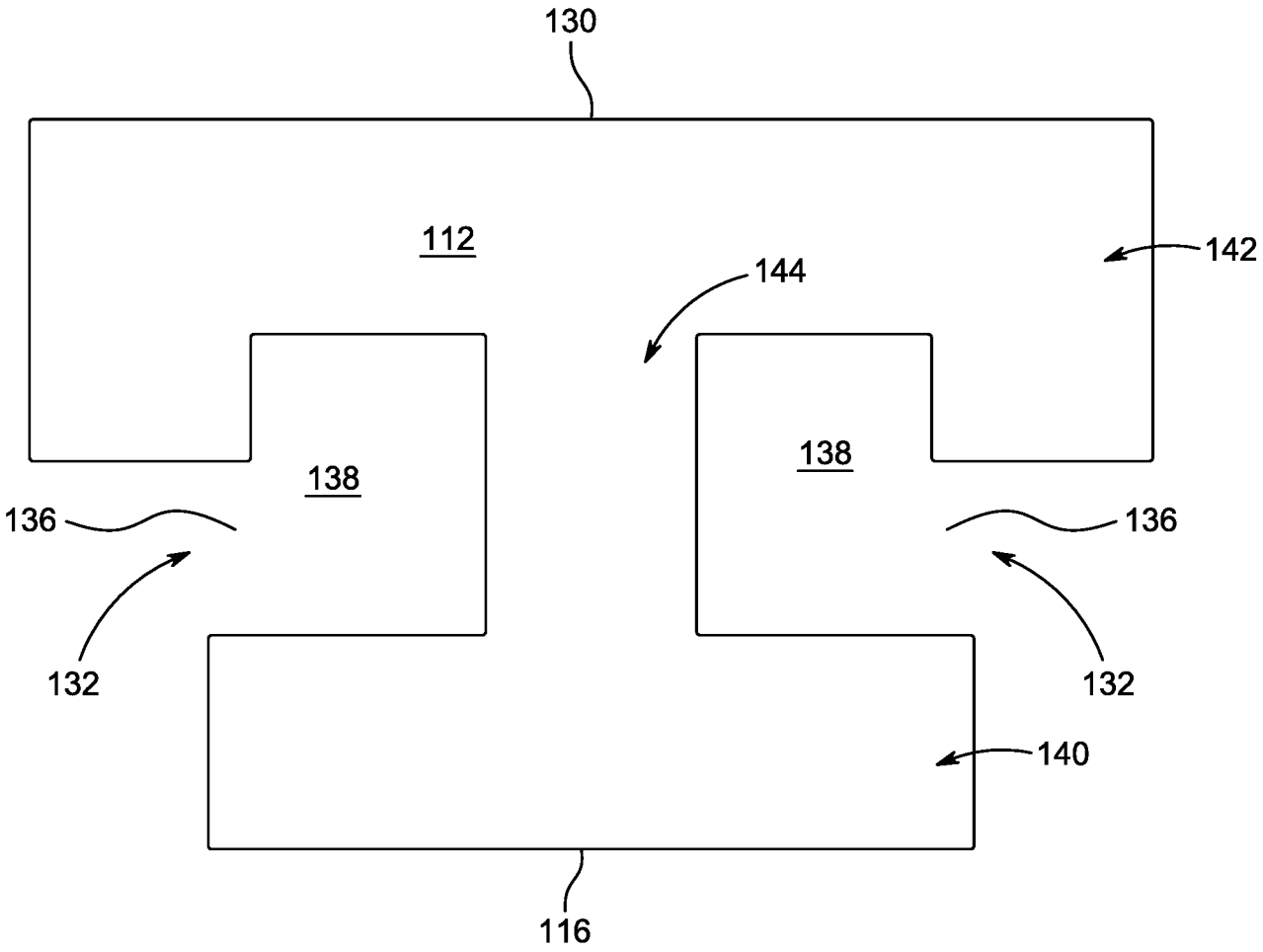
FIG. 8 is a top/bottom view of an exemplary connecting post of the modular wall system according to the present disclosure.
Figure 9:
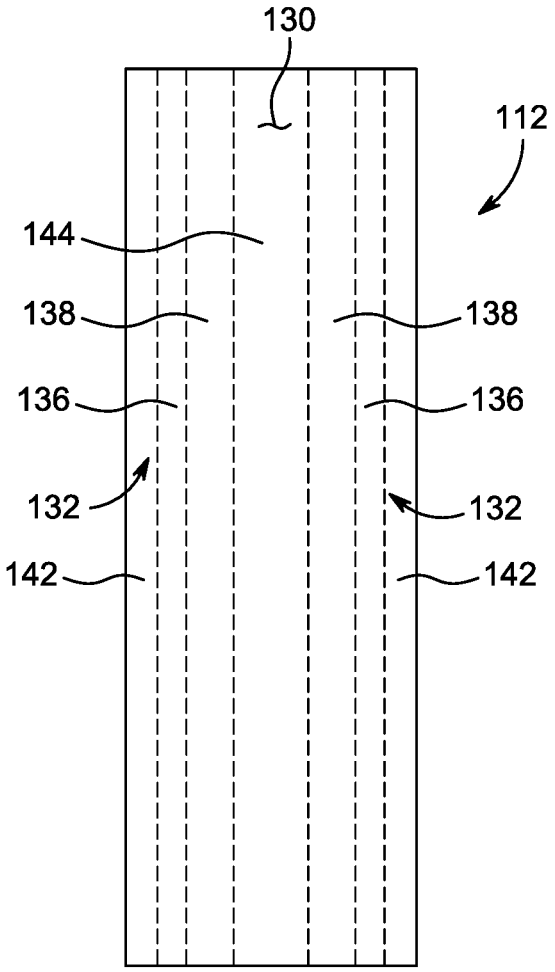
FIG. 9 is a front view of the connecting post of FIG. 8.

As shown in FIGS. 8-12, the connecting post 112 may include a front portion 140, a back portion 142 and a medial portion 144 positioned between the front portion 140 and back portion 142 along the thickness T direction. In some embodiments, opposing ends or sides of the medial portion 144 of the connecting post 112 along the thickness T direction may include a front portion 140 and a back portion 142 extending therefrom, as shown in FIGS. 8-12. The front portion 140, back portion 142 and medial portion 144 of the connecting post 112 may each extend substantially along the entirely of the height H of the connecting post 112 (i.e., may include the same height) as shown in FIGS. 9-11, which may extend substantially along the entirely of the height H of the panels 14 coupled thereto (i.e., along the entirely of the height H of the panels 114) as shown in FIGS. 1-3. In some other embodiments, the front portion 140, back portion 142 and medial portion 144 may extend along only portion of the height H of the connecting post 112 (i.e., one or more portion of the connecting post 112 may be shorter than one or more other portion thereof).

As shown in FIGS. 8-12, the front portion 140 of the connecting post 112 may form a front face 116 and the back portion 142 of the connecting post 112 may form a back face 130. As noted above, the front face 116 and/or the back face 130 of the connecting post 112 may or may not be finished or decorative (pre- and/or post-assembly). For example, the front face 116 and/or the back face 130 may include a faux stone or any other finish, which may be formed (at least partially) during the formation of the connecting post 112. In some embodiments, only the front face 116 may be finished or decorative (pre- and/or post-assembly). In some other embodiments, only back face 130 may be finished or decorative (pre- and/or post-assembly). In some other embodiments, both the front face 116 and the back face 130 may be finished or decorative (pre- and/or post-assembly). If finished, the front face 116 of the connecting post 112 may be finished to match or coordinate with a finish of the front face 116 of a panel 14 being coupled with the connecting post 112.

As shown in FIGS. 8, 11 and 12, the front face 116 and/or back face 130 of the connecting post 112 may be substantially planar. In some other embodiments, as described below, at least one of the front face 116 and/or back face 130 of the connecting post 112 may be non-planar, such as arcuate or curvilinear. In some embodiments, the front face 116 and the back face 130 of the connecting post 112 may be substantially parallel such that the thickness T of the connecting post 112 measured between the front face 116 and the back face 130 is substantially uniform along the height H and length L of the connecting post 112, as shown in FIGS. 8, 11 and 12. In some other embodiments, the thickness T of the connecting post 112 measured between the front face 116 and back face 130 may vary along the height H and/or length L directions.

As shown in FIGS. 8-12, the connecting post 112 may form or include at least two connector slots or grooves 132 for mating with corresponding connector portions 22 of panels 14 to removably couple the panels 14 together in a particular arrangement, orientation or configuration (and therefore removably couple the panels 14 and the connecting post 112 together). The connecting post 112 and/or the connector slots 132 may be configured to removably couple at least a pair panels 14 together via the connector portions 22 thereof in any arrangement, orientation or relative configuration. As discussed above, a variety of differing panels 14 and/or connecting posts 112 may thereby be utilized to form any shape or configuration of a frameless wall structure.

In some embodiments, the connector slots 132 of the connecting post 112 may be positioned at opposing lateral sides or ends of the connecting post 112. In other embodiments, the connector slots 132 may not be positioned at opposing lateral sides of the connecting post 112. As shown in FIG. 8, in some embodiments the connector slots 132 may be positioned in a medial portion of the thickness T direction of the connecting post 112. As also shown in FIGS. 8-12, the connector slots 132 may extend linearly and, potentially, substantially parallel to each other. In some other embodiments, the connector slots 132 may extend non-linearly and/or be angled/offset with respect to each other. The connector slots 132 may be configured such that when a bottom end or surface of the connecting post 112 is positioned on level ground or the connecting post 112 is otherwise orientated substantially vertically (e.g., along the height H direction), the connector slots 132 are orientated substantially vertically.

The connector slots 132 (and thereby the connector portions 22 of panels 14 received therein) may be spaced from each other in the length L direction with the medial portion 144 extending therebetween, as shown in FIG. 8. As also shown in FIG. 8, the connector slots 132 (and thereby the connector portions 22 of panels 14 received therein) may be aligned along the thickness T direction. However, the connector slots 132 may be offset along the thickness T direction. The connector slots 132 may be oriented substantially the same, but from an opposing direction along the length L direction (i.e., mirrored arrangements about a midline of the length L of the connecting post 112 that extends along the thickness T direction) with respect to the front face 116, back face 130, back portion 142, medial portion 144 and/or front portion 140 of the connecting post 112. In this way, the connecting post 112 may be symmetrical or a mirror image about a midline of the length L of the connecting post 112 that extends along the thickness T direction. The connecting post 112 may also be symmetrical or a mirror image about a midline of the height H of the connecting post 112 that extends along the length L direction.

Figure 13:
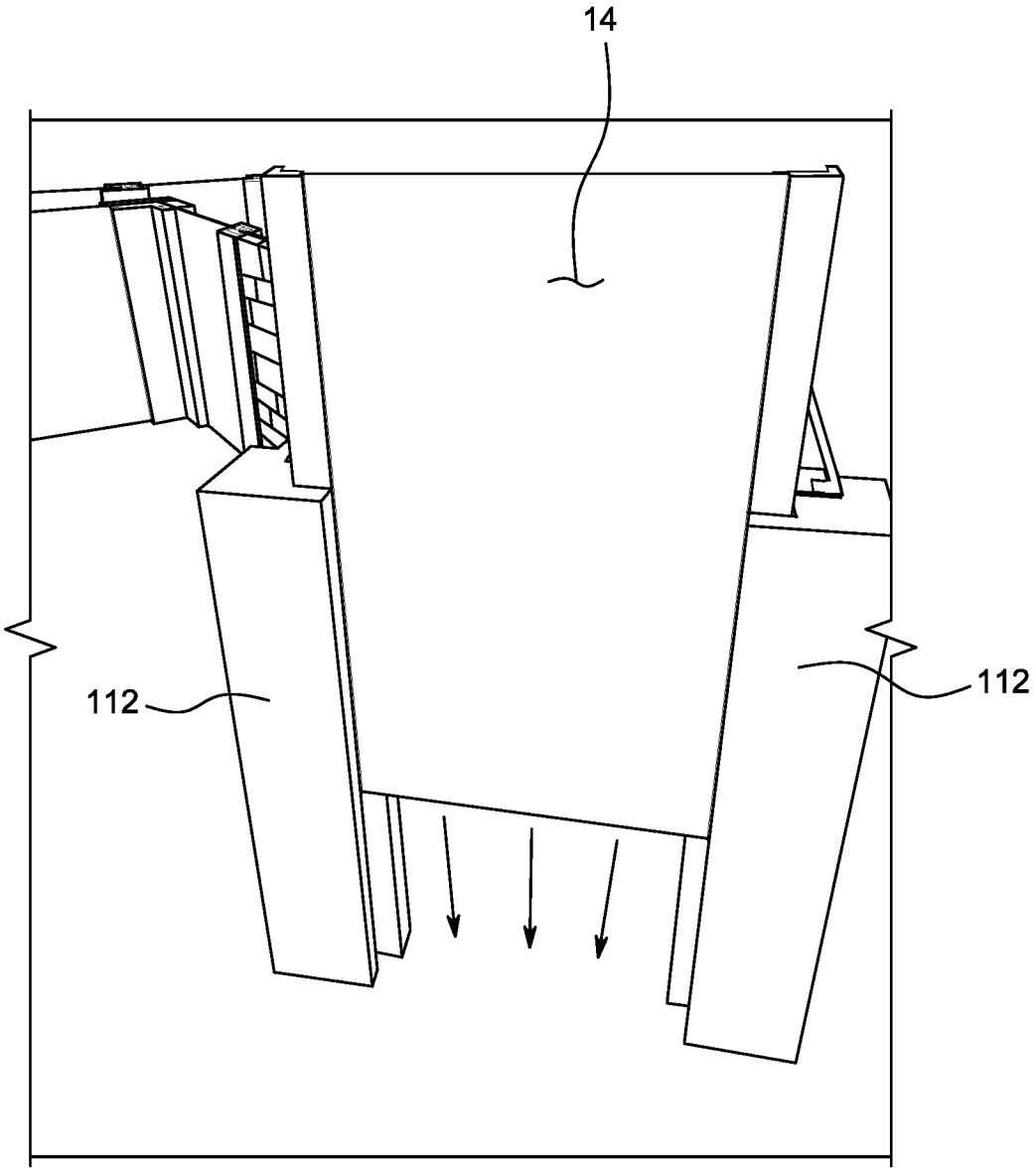
FIG. 13 is a perspective view illustrating the coupling process of the connecting post and pair of wall panels of FIG. 12.

The connector slots 132 of the connecting posts 112 may be configured to substantially match or correspond to the connector portions 22 of the panels 14, as shown in FIG. 12. The shape, size and configuration of the connector slots 132 may substantially match that of the connector portions 22 of the panels 14. In this way, a connector portion 22 of a panel 14 may be slid into a connector slot 132 of a connecting post 112 along the height H direction as shown in FIG. 13, and the connector portion 22 may be tightly contained within the connector slot 132 as shown in FIG. 12. Once the connector portion 22 of a panel 14 is slid into a connector slot 132 of a connecting post 112, or vice versa, the panel 14 and the connecting post 112 are locked together or fixedly coupled to each other but for the sliding direction along the connector portion 22 and the connector slot 132 (i.e., relative movement between the panel 14 and the connecting post 112 is prevent but for sliding or axial movement along the connector portion 22 and the connector slot 132, and relative movement along all other directions is prevent).

As shown in FIGS. 8 and 12, the connector slot 132 of the connecting posts 112, just as the connector portions 22 of the panels 14, may include a narrow portion 136 and a wide portion 138. As shown in FIG. 8, the narrow portion 136 of the connecting posts 112 may extend laterally or longitudinally along the length L direction and between innermost surfaces of the front portion 140 and back portion 142 along the thickness T direction. The narrow portion 136 may extend laterally inward along the length L direction toward the interior or medial portion 144 of the connector slot 132 and to the wide portion 138. The narrow portion 138 of each connector slot 132 may thereby open or exposed to the exterior of the exterior of the connecting post 112. The narrow portion 136 of the connector slots 132 may be configured to correspond or substantially match the narrow portion 28 of the connectors 22 of the panels 14. In this way, the surfaces of the front portion 140 and back portion 142 of the connecting posts 112 that form the narrow portion 136 may abut or mate and mirror the front and back surfaces, respectively, of the narrow portion 28 of the connector portions 22 of the panels 14 (when the panels 14 and connecting posts 112 are assembled), as shown in FIG. 12.

The wide portion 138 of each connector slot 132 may define the lateral end of the connector slot 132 along the length L direction, and may extend laterally along the length L direction from the narrow portion 136 to the medial portion 144 of the connecting post 112. The medial portion 144 may thereby form the interior or medial side or end of the wide portion 138, and thereby the innermost side or end of the connector slot 132 along the length L direction. The innermost side or end of the connector slot 132 along the length L direction formed by the medial portion 144 of the connecting post 112 may be configured to abut and mirror with the outermost or lateral ends of the connector portions 22 of the panels 114 along the length L direction (when the panels 14 and connecting posts 112 are assembled), as shown in FIG. 12. Along the thickness T direction, inner or interior sides of the front portion 140 and back portion 142 may form the wide portion 138, as shown in FIG. 8. As also shown in FIG. 8, the inner or interior surface of the front portion 140 forming the narrow portion 138 and the wide portion 138 of the connector slots 132 may be parallel and linear. Stated differently, the inner or interior surface of the front portion 140 may be planar and include a first portion that forms the front side of narrow portion 138 and a second portion that forms the front side of the wide portion 138 of the connector slots 132, as shown in FIG. 8. The inner or interior surface of the back portion 142 of the connector slots 132 that forms the back side or edge of the wide portion 138 may be further spaced along the thickness T direction from the inner or interior side or edge of the front portion 140 that forms the front side edge of the wide and narrow portions 138, 136 as the inner or interior surface of the back portion 142 of the connector slots 132 that forms the back side or edge of the narrow portion 136, as shown in FIG. 8. The wide portion 138 of the connector slots 132 may be configured to correspond or substantially match the wide portion 26 of the connectors 22 of the panels 14. In this way, the surfaces of the front portion 140 and back portion 142 of the connecting posts 112 that form the wide portion 138 may abut and mirror the front and back surfaces, respectively, of the wide portion 26 of the connector portions 22 of the panels 14 (when the panels 14 and connecting posts 112 are assembled), as shown in FIG. 12.

In some embodiments as shown in FIGS. 8 and 12, the interior surface of the back portion 142 of the connecting posts 112 that forms the narrow portion 136 of the connector slots 132 thereof may extend laterally outward further past the narrow portion 136 (i.e., the back portion 142 may extend laterally outward further past the narrow portion 136). As shown in FIG. 12, the interior surface of the back portion 142 of the connecting posts 112 that forms the narrow portion 136 of the connector slots 132 thereof may thereby mate and abut (or extend along) the back face 20 of the panel portion 24 of a panel 14 (when the panels 14 and connecting posts 112 are assembled). Stated differently, when a panel 14 and a connecting post 112 are assembled, the back portion 142 of the connecting post 112 may mate and abut a portion of the back side surface 20 of the panel portion 24 of the panel 14, as shown in FIG. 12.

In some embodiments as shown in FIGS. 8 and 12, the lateral side surface or end of the front portion 140 of the connecting posts 112 that extends between the interior surface that forms the narrow portion 132 of a connecting slot 132 and the front face 116 may mate and abut the lateral side surface of the panel portion 24 of the panel 14 (when the panel 14 and connecting post 112 are assembled). As noted above, at least a portion of the front face 116 of the front portion 140 of the connecting posts 112 may abut and extend parallel to the front face 18 of the panels 14 coupled thereto, as shown in FIG. 12. In this way, the connections between the connecting posts 112 and the panels 14 may appear smooth and tight (i.e., may form a tight seam) from the front of the assembly.

As shown in FIG. 13, a connector 22 of a panel 14 may be manually aligned with and slid into the connector slot 132 of one or more connecting post 112 along the height H direction with the wide portion 26 and the narrow portion 28 of the connector 22 of the panel 14 positioned within the wide portion 138 and the narrow portion 136, respectively, of the corresponding connecting slot 132 and the one or more connecting post 112. The narrow portion 136 of the one or more connecting post 112 will thereby prevent the connecting post 112 and the panel 14 from translating apart along the length L direction, and the connector slot 132 as a whole will prevent the connecting post 112 and the panel 14 from translating apart along the thickness T direction.

Figure 14:
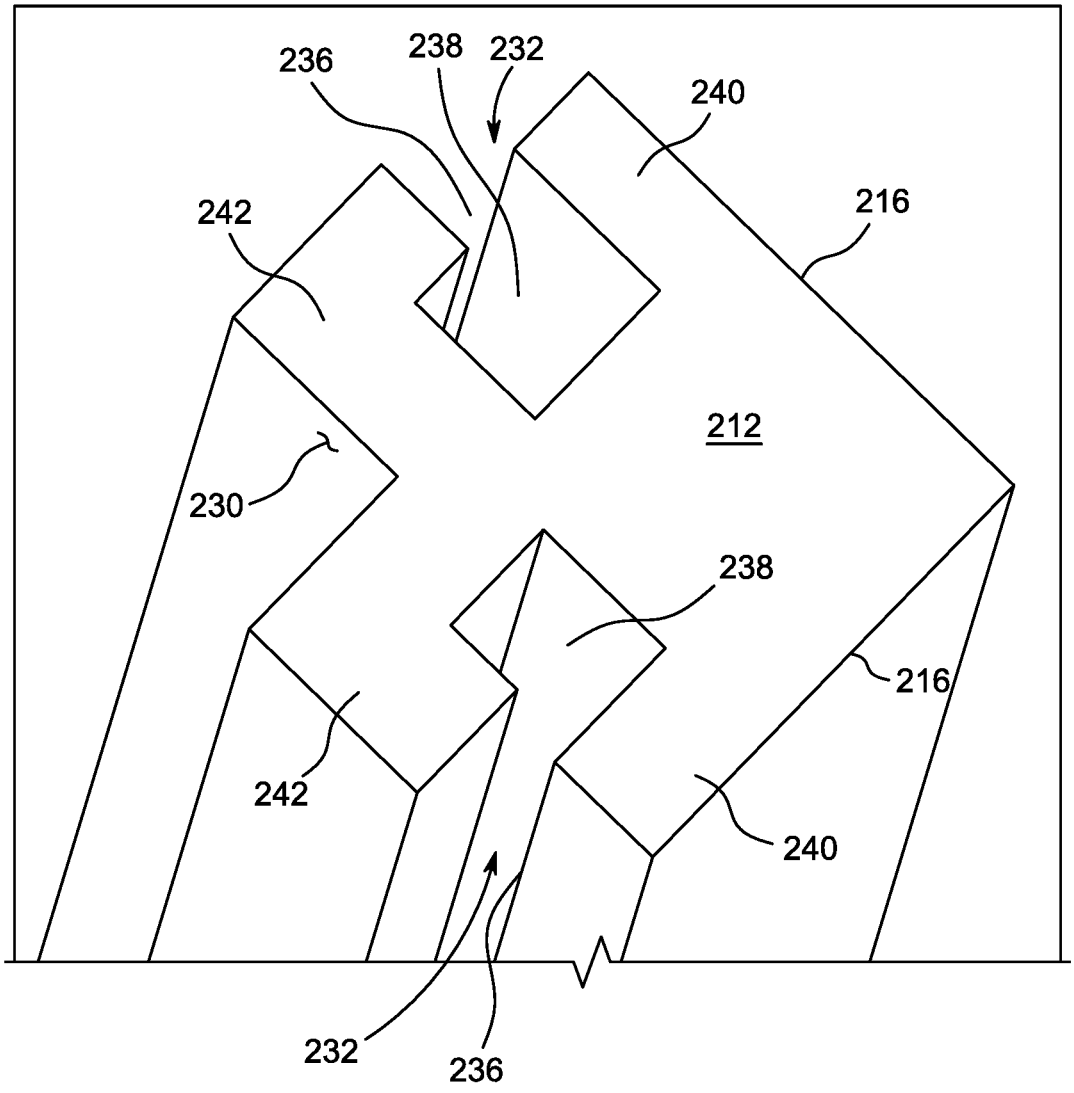
FIG. 14 is a elevational perspective view of another exemplary connecting post of the modular wall system according to the present disclosure.
Figure 15:
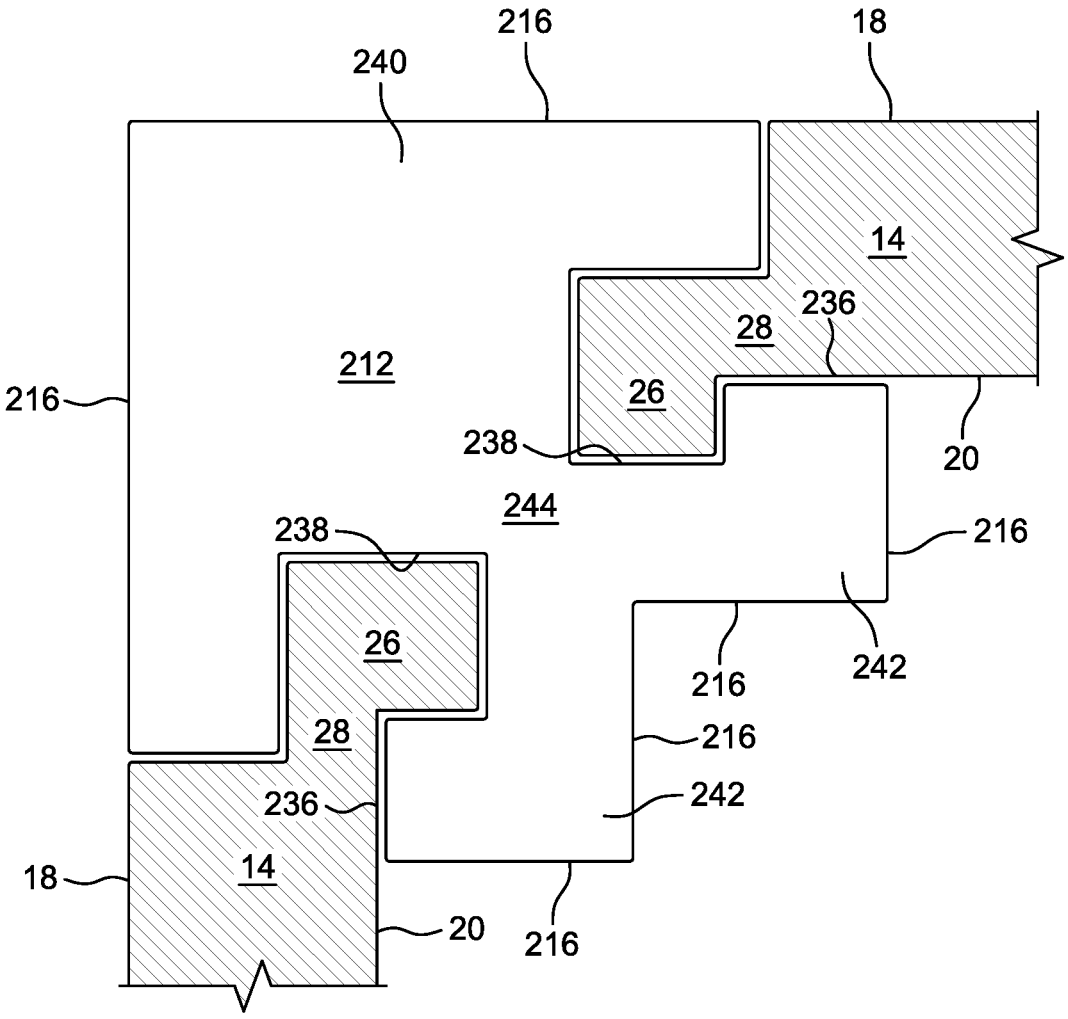
FIG. 15 is a top/bottom view of the connecting post of FIG. 14 coupling a pair of wall panels.

In FIGS. 14 and 15 illustrate another exemplary connecting post that is indicated generally by the reference numeral 212. The exemplary connecting post 212 is substantially similar to exemplary connecting post 112 described above with reference to FIGS. 8-12, and therefore like reference numerals preceded by the numeral "2" are used to indicate like elements. A difference between the exemplary connecting post 212 and the exemplary connecting post 112 is the relative orientation of the connecting slots 232. As shown in FIGS. 14 and 15, the connecting post 212 (and/or the connecting slots 232) may be configured to form a relatively sharp outside corner such that a pair of panels 14 (such as, but not limited to, planar panels) are oriented at a relatively sharp angle with respect to each other. For example, the connecting post 212 may be configured to form a 90 degree or right outside corner such that the front faces 18 of the pair of panels 14 are oriented at 270 degrees from each other. As also shown in FIGS. 14 and 15, the front face 216 of the connecting post 212 may include two portions that extend from a corresponding connecting slot 232. The portions of the front face 216 of the connecting post 212 may be planar and/or parallel to the respective front face 18 of the panels 14. The front face 216 of the connecting post 212 may thereby form a 90 degree or right outside corner such that the portions of the front faces 216 are oriented at 270 degrees from each other.

Figure 16:
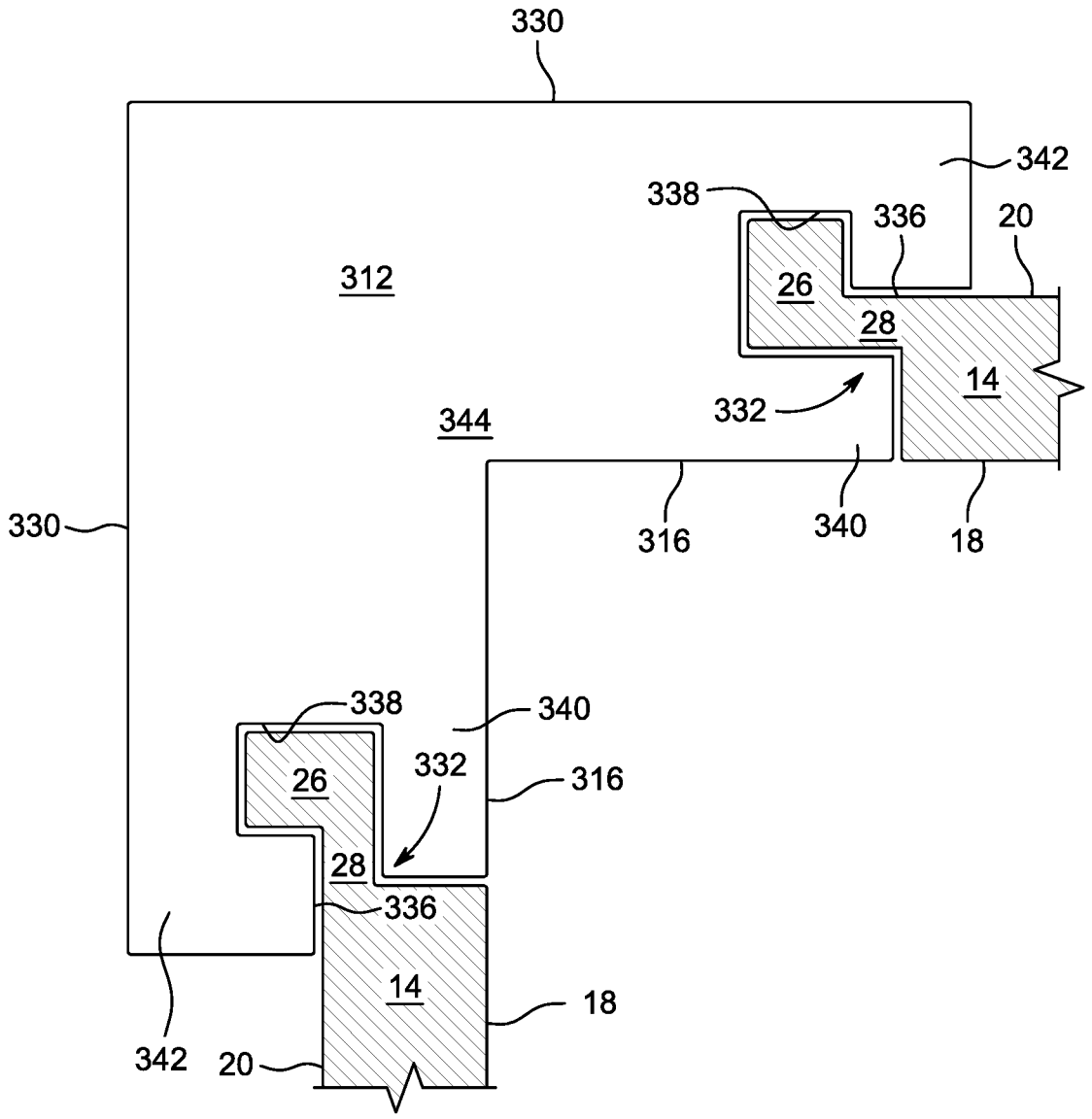
FIG. 16 is a top/bottom view of another exemplary connecting post of the modular wall system coupling a pair of wall panels according to the present disclosure.

FIG. 16 illustrates another exemplary connecting post that is indicated generally by the reference numeral 312. The exemplary connecting post 312 is substantially similar to exemplary connecting post 212 described above with reference to FIGS. 14 and 15 and the exemplary connecting post 112 described above with reference to FIGS. 8-12, and therefore like reference numerals preceded by the numeral "3" are used to indicate like elements. A difference between the exemplary connecting post 312 and the exemplary connecting post 212 and the exemplary connecting post 312 is the relative orientation of the connecting slots 332. As shown in FIG. 16, the connecting post 312 (and/or the connecting slots 332) may be configured to form a relatively sharp inside corner such that a pair of panels 14 are oriented at a relatively sharp angle with respect to each other. For example, the connecting post 312 may be configured to form a 90 degree or right inside corner such that the front faces 18 of the pair of panels 14 are oriented at 90 degrees from each other. As also shown in FIG. 16, the front face 316 of the connecting post 312 may include two portions that extend from a corresponding connecting slot 332. The portions of the front face 316 of the connecting post 312 may be planar and/or parallel to the respective front face 18 of the panels 14. The front face 316 of the connecting post 312 may thereby form a 90 degree or right inside corner such that the portions of the front face 316 are oriented at 90 degrees from each other.

Figure 17:
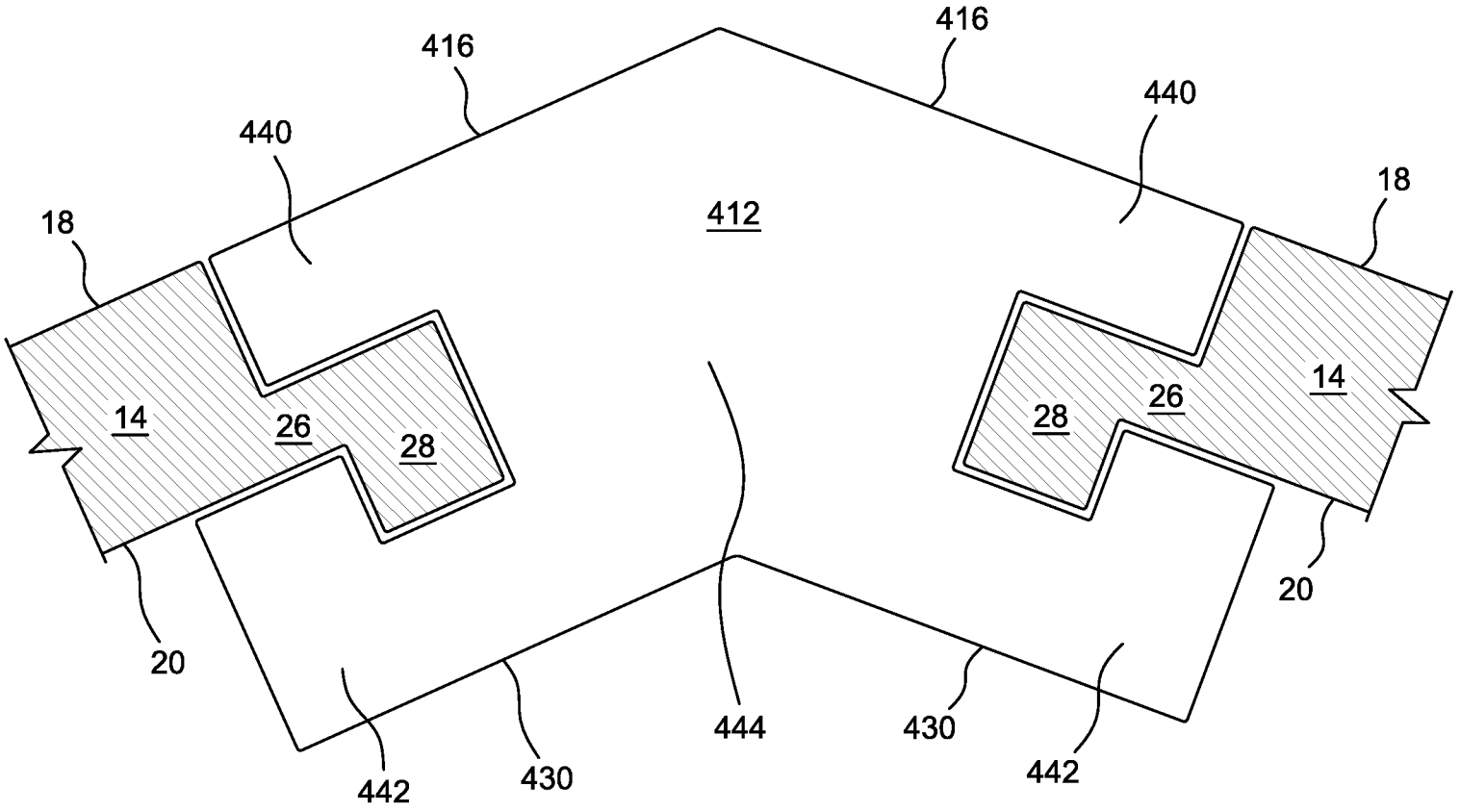
FIG. 17 is a top/bottom view of another exemplary connecting post of the modular wall system coupling a pair of wall panels according to the present disclosure.

FIG. 17 illustrates another exemplary connecting post that is indicated generally by the reference numeral 412. The exemplary connecting post 412 is substantially similar to the exemplary connecting post 312 described above with reference to FIG. 16, the exemplary connecting post 212 described above with reference to FIGS. 14 and 15, and the exemplary connecting post 112 described above with reference to FIGS. 8-12, and therefore like reference numerals preceded by the numeral "4" are used to indicate like elements. A difference between the exemplary connecting post 412 and the exemplary connecting post 312, the connecting post 212, and the exemplary connecting post 112 is the relative orientation of the connecting slots 432. As shown in FIG. 17, the connecting post 412 (and/or the connecting slots 432) may be configured to form a relatively shallow or blunt outside corner such that a pair of panels 14 are oriented at a relatively shallow outside angle with respect to each other. For example, the connecting post 412 may be configured to form a 45 degree outside corner such that the front faces 18 of the pair of panels 14 are oriented at 135 degrees from each other. As also shown in FIG. 17, the front face 416 of the connecting post 412 may include two portions that extend from a corresponding connecting slot 432. The portions of the front face 416 of the connecting post 412 may be planar and/or parallel to the respective front face 18 of the panels 14. The front face 416 of the connecting post 412 may thereby form a 45 degree outside corner such that the portions of the front face 416 are oriented at 135 degrees from each other.

Figure 18:
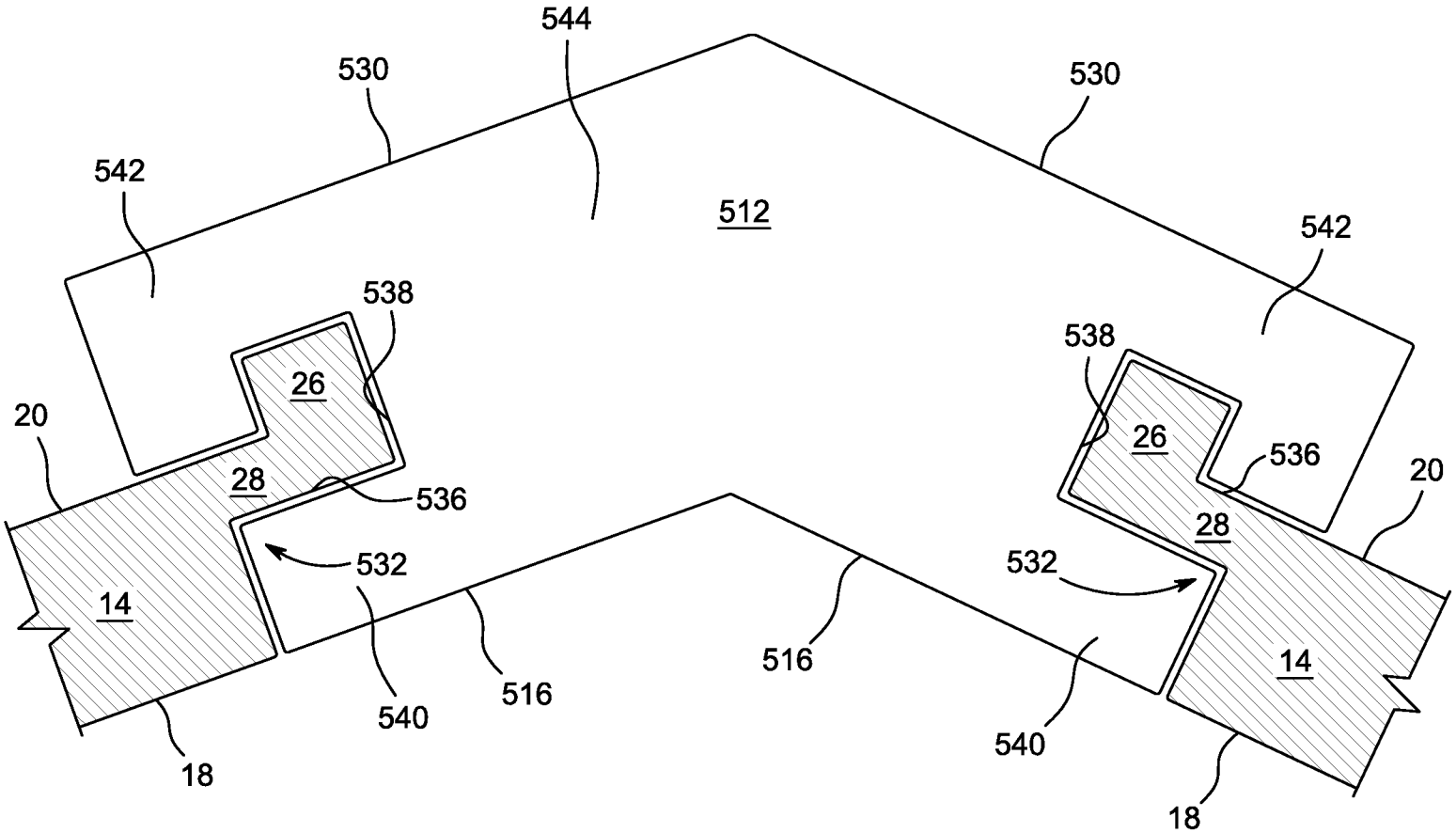
FIG. 18 is a top/bottom view of another exemplary connecting post of the modular wall system coupling a pair of wall panels according to the present disclosure.

FIG. 18 illustrates another exemplary connecting post that is indicated generally by the reference numeral 512. The exemplary connecting post 512 is substantially similar to the exemplary connecting post 412 described above with reference to FIG. 17, the exemplary connecting post 312 described above with reference to FIG. 16, the exemplary connecting post 212 described above with reference to FIGS. 14 and 15, and the exemplary connecting post 112 described above with reference to FIGS. 8-12, and therefore like reference numerals preceded by the numeral "5" are used to indicate like elements. A difference between the exemplary connecting post 512 and the exemplary connecting post 412, the exemplary connecting post 312, the connecting post 212 and the exemplary connecting post 112 is the relative orientation of the connecting slots 532. As shown in FIG. 18, the connecting post 512 (and/or the connecting slots 532) may be configured to form a relatively shallow or blunt inside corner such that a pair of panels 14 are oriented at a relatively shallow inside angle with respect to each other. For example, the connecting post 512 may be configured to form a 45 degree inside corner such that the front faces 18 of the pair of panels 14 are oriented at 45 degrees from each other. As also shown in FIG. 18, the front face 516 of the connecting post 512 may include two portions that extend from a corresponding connecting slot 532. The portions of the front face 516 of the connecting post 512 may be planar and/or parallel to the respective front face 18 of the panels 14. The front face 516 of the connecting post 512 may thereby form a 45 degree inside corner such that the portions of the front face 516 are oriented at 45 degrees from each other.

Figure 19:
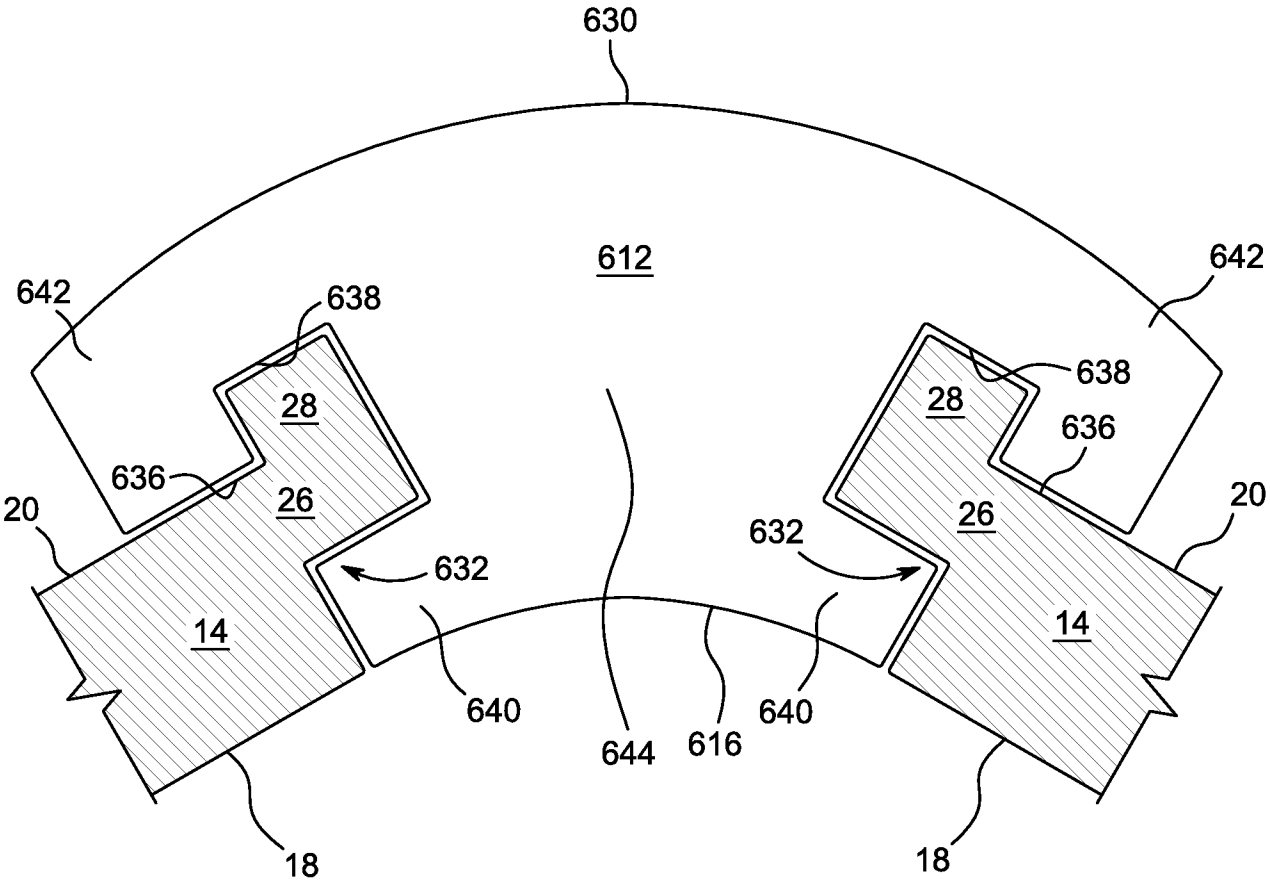
FIG. 19 is a top/bottom view of another exemplary connecting post of the modular wall system coupling a pair of wall panels according to the present disclosure.

FIG. 19 illustrates another exemplary connecting post that is indicated generally by the reference numeral 612. The exemplary connecting post 612 is substantially similar to the exemplary connecting post 512 described above with reference to FIG. 18, the exemplary connecting post 412 described above with reference to FIG. 17, the exemplary connecting post 312 described above with reference to FIG. 16, the exemplary connecting post 212 described above with reference to FIGS. 14 and 15, and the exemplary connecting post 112 described above with reference to FIGS. 8-12, and therefore like reference numerals preceded by the numeral "6" are used to indicate like elements. A difference between the exemplary connecting post 612 and the exemplary connecting post 512, the connecting post 412, the exemplary connecting post 312, the connecting post 212 and the exemplary connecting post 112 is the relative orientation of the connecting slots 632 and the front face 61. As shown in FIG. 19, the connecting post 612 (and/or the connecting slots 632) may be configured to form a relatively shallow or blunt inside corner between adjacent panels 14, such as but not limited to a pair of curved panels 14. It is noted, however, that the panels 14 may not be curved panels 14 (e.g., may be planar panels 14).

As shown in FIG. 19, the connecting post 612 may be configured to form a curved inside corner defined by a radius, which may be the same or substantially similar to the radius of front face 18 of the curved panels 14. The connecting post 612 may thereby act as an arc extending between the pair of panels 14. The front face 616 of the connecting post 612 may thereby be a curved surface that extends between the connecting slots 632. The curvature of the front face 616 of the connecting post 612 may substantially match the curvature of the front faces 18 of the panels 14. The front face 616 of the connecting post 612 may thereby form an arcuate, radiused, or curved inside corner extending between (and along) the panels 14. In other embodiments, the front face 616 of the connecting post 612 may form an arcuate, radiused, or curved outside corner extending between the panels 14.

The present disclosure thereby provides frameless modular wall systems, frameless modular free-standing wall structures, and related methods. The systems and structures may be especially advantageous as outdoor systems and structures. The systems and structures provide a relatively low-cost building solution that is relatively easy to install. The systems and structures include the use of advantageous connecting members or posts and panels that are interchangeable and couple together in a sliding manner without the need of fasteners or tools. The connecting posts and panels may be pre-finished such that the resulting structure is complete and has an aesthetically pleasing look immediately upon installation or assembly.

The systems and structures includes connecting members and panels that are differing of differing configurations, such as panels of lengths and/or heights and, potentially, planar and/or non-planar, and posts of differing number of panel-connections and/or relative angulation or orientation of connected panels. By utilizing differing combinations of such differing connecting posts and/or panels, any configuration or arrangement of a modular wall structure can be formed. For example, systems and structures may allow a user to create their own walled structure design, with the potential to build-out (or take away from) and/or rearrange with the wall structure over time. In some embodiments, the posts and/or the panels may be of one piece construction.

The systems and structures may form independent, free-standing, modular walled structures. For example, the posts and panels may be configured to form independent, free-standing, modular walled structures. In this way, the systems and structures may be frameless and void of a foundation affixed thereto. The posts and panels of the systems and structures may removably couple tougher via a tongue and groove configuration that prevents the components from disengaging during use (but allows for selective disassembly and reuse, if desired), and forms sturdy free-standing structure without an internal or external frame and/or a foundation.

As may be recognized by those of ordinary skill in the pertinent art based on the teachings herein, numerous changes and modifications may be made to the above-described and other embodiments of the present invention without departing from the spirit of the invention as defined in the claims. Accordingly, this detailed description of the illustrated and exemplary embodiments of the present invention is to be taken in an illustrative, as opposed to a limiting sense. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably" in conjunction with terms such as coupled, connected, joined, sealed or the like is used herein to refer to both connections resulting from separate, distinct components being directly or indirectly coupled and components being integrally formed (i.e., one-piece, integral or monolithic). Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A frameless modular wall system, comprising:

a plurality of panels including a wall portion and connector portions extending from opposing lateral sides of the wall portion, the connector portions each including a wide portion and a narrow portion extending between the wide portions and the wall portion; and a plurality of connecting posts including connector slots configured to removably accept a connector portion of a panel therein that extend from an uppermost top end surface to a lowermost bottom end surface of the connecting posts, the connector slots each including a wide portion and a narrow portion corresponding to the wide portion and the narrow portion of the connector portions of the panels, wherein, when the plurality of panels and the plurality of connecting posts are removably coupled via the connector portions and the connector slots, the panels and connecting posts form a free-standing wall structure, and wherein the bottom end surface of the connecting posts comprises a planar surface configured to overly an uppermost ground surface.

2. The modular wall system of claim 1, wherein the connector portions define lateral free ends of the panels.

3. The modular wall system of claim 1, wherein the plurality of connecting posts include at least one connecting post that forms an outside corner between adjacent panels removably couple thereto.

4. The modular wall system of claim 1, wherein the plurality of connecting posts include at least one connecting post that forms an inside corner between adjacent panels removably couple thereto.

5. The modular wall system of claim 1, wherein the wall portion of the plurality of panels include a pre-finished front face.

6. The modular wall system of claim 1, wherein the connecting posts include a pre-finished front face extending between a pair of connector slots.

7. The modular wall system of claim 1, wherein the wall portion of the plurality of panels includes a front face extending between a pair of connector portions, and the connecting posts include a front face extending between a pair of connector slots, and wherein the front faces of adjacent panels and connecting posts are aligned at the junction thereof when the connector portions are positioned within the connector slots.

8. The modular wall system of claim 7, wherein the plurality of panels include at least one panel that includes a planar front face or an arcuate front face.

9. The modular wall system of claim 1, wherein the wide portion and the narrow portion of each connecting portion include front faces that are coplanar with each other.

10. The modular wall system of claim 1, wherein a back portion of the connecting posts that forms a back side of the connector slots extends laterally further than a front side of the connecting posts that forms a front side of the connector slots and front faces of the connecting posts.

11. The modular wall system of claim 1, wherein the plurality of connecting posts include at least one connecting post that includes a planar front face extending between a pair of connector slots.

12. The modular wall system of claim 1, wherein the plurality of connecting posts include at least one connecting post that includes an arcuate front face extending between a pair of connector slots.

13. The wall system of claim 1, wherein the plurality of connecting posts are each of one-piece construction.

14. The wall system of claim 1, wherein the plurality of connecting posts and/or the plurality of panels are molded from a cementitious material.

15. The modular wall system of claim 1, wherein the plurality of connecting posts include connecting posts that form differing relative orientations of a pair of adjacent panels removably couple thereto.

16. The modular wall system of claim 1, wherein the plurality of panels comprise panels of differing lateral lengths and/or heights.

17. The modular wall system of claim 1, wherein the free-standing wall structure forms an inner void extending between inner surfaces of the plurality of panels and plurality of connecting posts that is void of a support frame.

18. The modular wall system of claim 1, wherein the bottom end surfaces of the connecting posts freely overly a ground surface such that they are not affixed thereto.

19. A frameless, modular, free-standing wall structure, comprising:

a plurality of one-piece panels including a wall portion and connector portions extending from opposing lateral sides of the wall portion, the connector portions each including a wide portion and a narrow portion extending between the wide portions and the wall portion; and a plurality of one-piece connecting posts including connector slots configured to removably accept a connector portion of a panel therein that extend from an uppermost top end surface to a lowermost bottom end surface of the connecting posts, the connector slots each including a wide portion and a narrow portion corresponding to the wide portion and the narrow portion of the connector portions of the panels, wherein the plurality of panels and the plurality of connecting posts are removably coupled via the connector portions and the connector slots, and wherein the bottom end surfaces of the connecting posts overly a ground surface and are not affixed thereto.

20. A method of forming a free-standing wall structure, comprising:

assembling a frameless modular wall system comprising:

obtaining a plurality of panels that each include a wall portion and connector portions extending from opposing lateral sides of the wall portion, the connector portions each including a wide portion and a narrow portion extending between the wide portions and the wall portion;

obtaining a plurality of connecting posts including connector slots configured to removably accept a connector portion of a panel therein that extend from an uppermost top end surface to a lowermost bottom end surface of the connecting posts, the connector slots each including a wide portion and a narrow portion corresponding to the wide portion and the narrow portion of the connector portions of the panels;

freely positioning the bottom end surfaces of the connecting posts on a ground surface such that they are not affixed thereto; and removably coupling the panels and the connecting posts into a desired free-standing wall structure configuration by sliding the connector portions into the connector slots from the top end surface to the bottom end surface of the connecting posts.

* * * * *